US010228648B2

(12) United States Patent
Kitajima

(10) Patent No.: US 10,228,648 B2
(45) Date of Patent: Mar. 12, 2019

(54) IMAGE FORMING APPARATUS THAT DETERMINES LIFETIME OF PHOTOSENSITIVE MEMBER

(71) Applicant: CANON KABUSHIKI KAISHA, Tokyo (JP)

(72) Inventor: Kenichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/806,811

(22) Filed: Nov. 8, 2017

(65) Prior Publication Data

US 2018/0143574 A1 May 24, 2018

(30) Foreign Application Priority Data

Nov. 18, 2016 (JP) ..... 2016-225551

(51) Int. Cl.
*G03G 15/00* (2006.01)

(52) U.S. Cl.
CPC ..... *G03G 15/553* (2013.01)

(58) Field of Classification Search
None
See application file for complete search history.

(56) References Cited

U.S. PATENT DOCUMENTS

| | | | | |
|---|---|---|---|---|
| 7,433,611 | B2 * | 10/2008 | Nagamochi | G03G 15/5037 399/26 |
| 7,457,550 | B2 * | 11/2008 | Shoji | G03G 15/55 399/9 |
| 8,275,272 | B2 * | 9/2012 | Stuckey | G03G 15/553 399/11 |
| 2006/0198659 | A1 * | 9/2006 | Niimi | G03G 5/0679 430/125.2 |

FOREIGN PATENT DOCUMENTS

| | | | |
|---|---|---|---|
| JP | 03-105375 | A | 5/1991 |
| JP | 08-194408 | A | 7/1996 |
| JP | 08194408 | A * | 7/1996 |
| JP | 2003-195701 | A | 7/2003 |
| JP | 2005-283736 | A | 10/2005 |
| JP | 2007-163975 | A | 6/2007 |
| JP | 2010-237194 | A | 10/2010 |
| JP | 2014-219843 | A | 11/2014 |

OTHER PUBLICATIONS

JP_08194408_A_T Aug. 1996, Japan, Sakurai.*
U.S. Appl. No. 15/664,419, Kenichiro Kitajima, filed Jul. 31, 2017.
U.S. Appl. No. 15/808,115, Kenichiro Kitajima, filed Nov. 9, 2017.

* cited by examiner

*Primary Examiner* — Victor Verbitsky
(74) *Attorney, Agent, or Firm* — Venable LLP

(57) ABSTRACT

An image forming apparatus includes a photosensitive member including a photosensitive layer and a protective layer provided outside the photosensitive layer; a charging member configured to electrically charge the photosensitive member; an exposure device configured to expose, to light, the photosensitive member charged by the charging member; a detecting member configured to detect a surface potential of the photosensitive member; and an output portion configured to output information on a lifetime of the photosensitive member. The output portion outputs the information on the basis of an exposure amount with which the photosensitive member charged is exposed to light and a detection result of the surface potentials of the photosensitive member by the detecting member before and after the photosensitive member is exposed to the light with the exposure amount.

4 Claims, 14 Drawing Sheets

(a)

(b)

(a)

(b)

IMAGE FORMING APPARATUS THAT DETERMINES LIFETIME OF PHOTOSENSITIVE MEMBER

FIELD OF THE INVENTION AND RELATED ART

The present invention relates to an image forming apparatus, of an electrophotographic type, such as a copying machine, a printer or a facsimile machine. Particularly, the present invention relates to the image forming apparatus including a photosensitive member in which a protective layer is provided as an outermost (surface) layer.

In the image forming apparatus of the electrophotographic type, a photosensitive member (electrophotographic photosensitive member) in which the protective layer is provided as the outermost layer and which is excellent in durability has been widely used. However, even in the photosensitive member including the protective layer, the protective layer is abraded by the influence of deposition of a discharge product due to charging or by mechanical abrasion, so that a film (layer) thickness of the protective layer decreases depending on an amount of use of the photosensitive member. Then, when the film thickness of the protective layer is a predetermined value or less, a charge potential or an exposed (light) portion potential of the photosensitive member becomes non-uniform, so that an image defect generates in some cases.

Therefore, Japanese Laid-Open Patent Application (JP-A) Hei 8-194408 and JP-A 2010-237194 propose a method in which a resistance measuring device or a reflectance measuring device is provided in an image forming apparatus and in which a film thickness of a protective layer of a photosensitive member is measured and then a lifetime of the photosensitive member is discriminated.

JP-A 2005-283736 proposes the following method in an image forming apparatus using an organic photosensitive member having a lamination layer structure of a photosensitive layer. This method is such that a DC component of a charging current flowing through the photosensitive member during a charging process is measured and a lifetime of the photosensitive member is discriminated on the basis of a relationship between a travel (movement) distance of the photosensitive member and the charging current depending on a film thickness of a charge transporting layer of the photosensitive member.

Further, JP-A 2003-195701 proposes the following method in an image forming apparatus using an organic photosensitive member having a single layer structure of a photosensitive layer. In this method, exposed portion potentials (VL) are formed by exposing the photosensitive member to light with a predetermined exposure amount at portions having a plurality of different charge potentials (VD). Then, a film thickness of the photosensitive layer is estimated on the basis of a relationship, acquired in advance, between the film thickness of the photosensitive layer and a slope of a "VD-VL characteristic", so that a lifetime of the photosensitive member is discriminated.

In the case of the photosensitive member in which the protective layer is provided as the outermost layer, the lifetime of the photosensitive member is determined by the film thickness of the protective layer. For that reason, it has been required that a change amount of the film thickness of the protective layer is measured accurately in the image forming apparatus.

However, in the constitutions of JP-A Hei 8-194408 and JP-A 2010-237194, there is a need to provide the resistance measuring device or the reflectance measuring device in the image forming apparatus, and therefore, there is a problem of increases in cost and size of the image forming apparatus. Further, in the constitutions of JP-A 2005-283736 and JP-A 195701, the proposed methods are effective in the case where a fluctuation of electrostatic capacity of the photosensitive member is relatively large due to abrasion (wearing) of the photosensitive layer of the photosensitive member having the single layer structure or the charge transporting layer of the photosensitive member having the lamination layer structure. For that reason, these constitutions cannot be applied to the case where the film thickness of the protective layer is thin (for example, 1 μm or less) relative to the film thickness of the photosensitive layer and the film thickness of the protective layer of the photosensitive member in which the electrostatic capacity little charges is intended to be measured. Thus, in the prior art, it was difficult to accurately measure the change amount of the film thickness of the protective layer of the photosensitive member without providing an exclusive measuring device in the image forming apparatus.

SUMMARY OF THE INVENTION

According to an aspect of the present invention, there is provided an image forming apparatus comprising: a photosensitive member including a photosensitive layer and a protective layer provided outside the photosensitive layer; a charging member configured to electrically charge the photosensitive member; an exposure device configured to expose, to light, the photosensitive member charged by the charging member; a detecting member configured to detect a surface potential of the photosensitive member; and an output portion configured to output information on a lifetime of the photosensitive member, wherein the output portion outputs the information on the basis of an exposure amount with which the photosensitive member charged is exposed to light and a detection result of the surface potentials of the photosensitive member by the detecting member before and after the photosensitive member is exposed to the light with the exposure amount.

Further features of the present invention will become apparent from the following description of exemplary embodiments with reference to the attached drawings.

Figure 3:
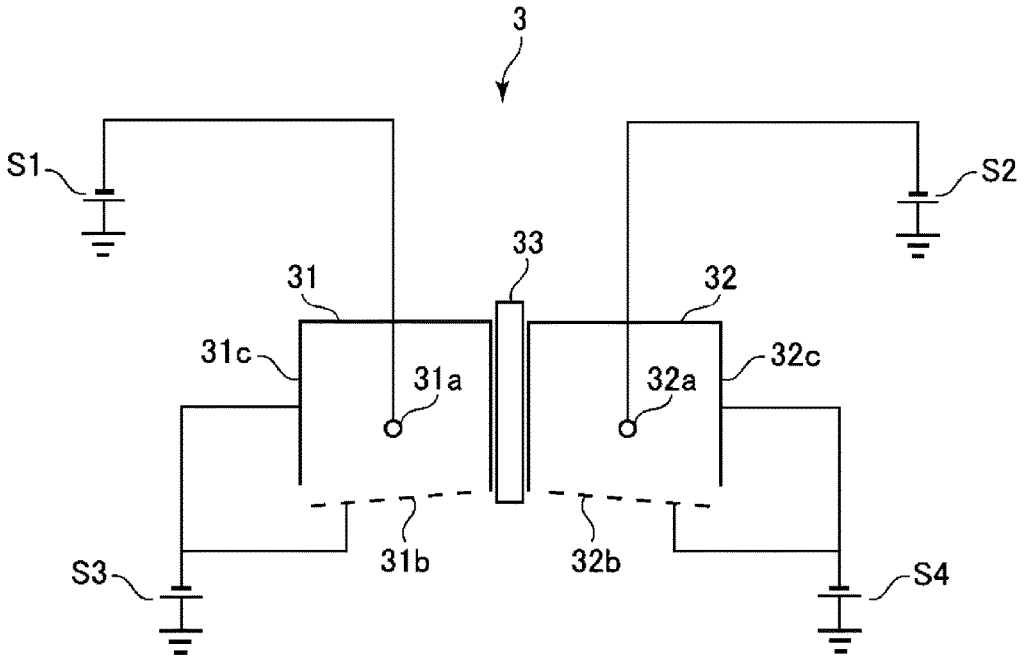
Figure 3:
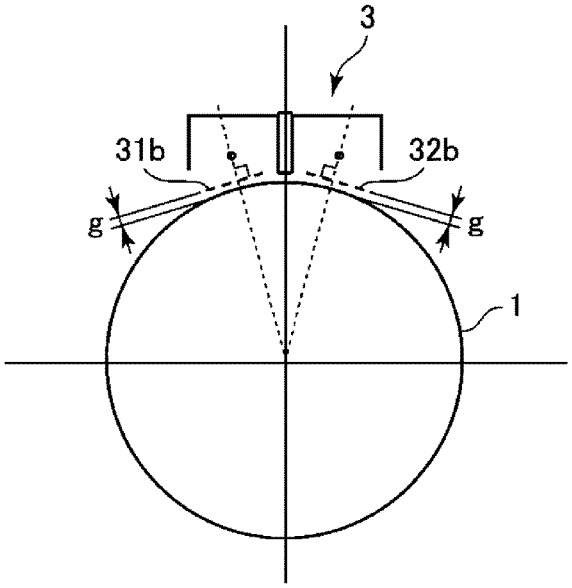

Parts (a) and (b) of FIG. 3 are schematic sectional views of a charging device.

Figure 4:
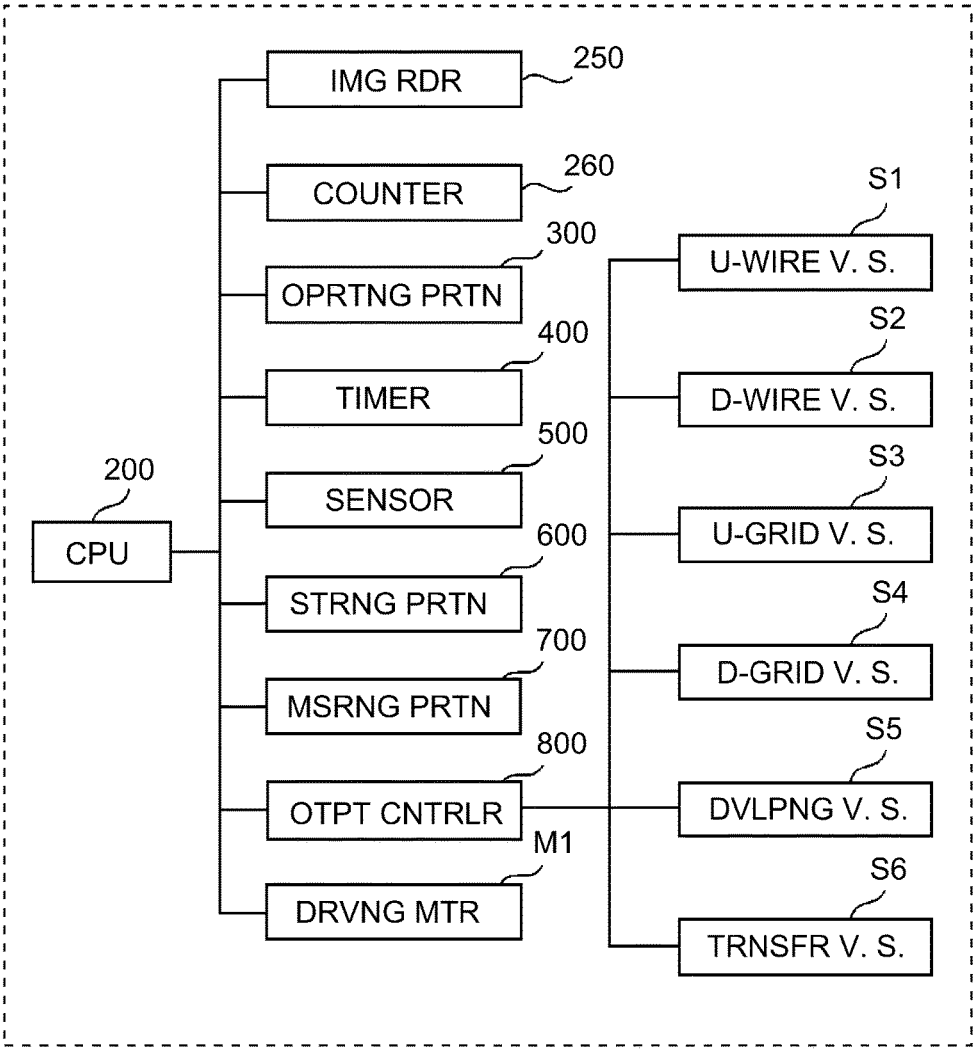

FIG. 4 is a block diagram showing a control mode of a principal part of the image forming apparatus in Embodiment 1.

Figure 5:
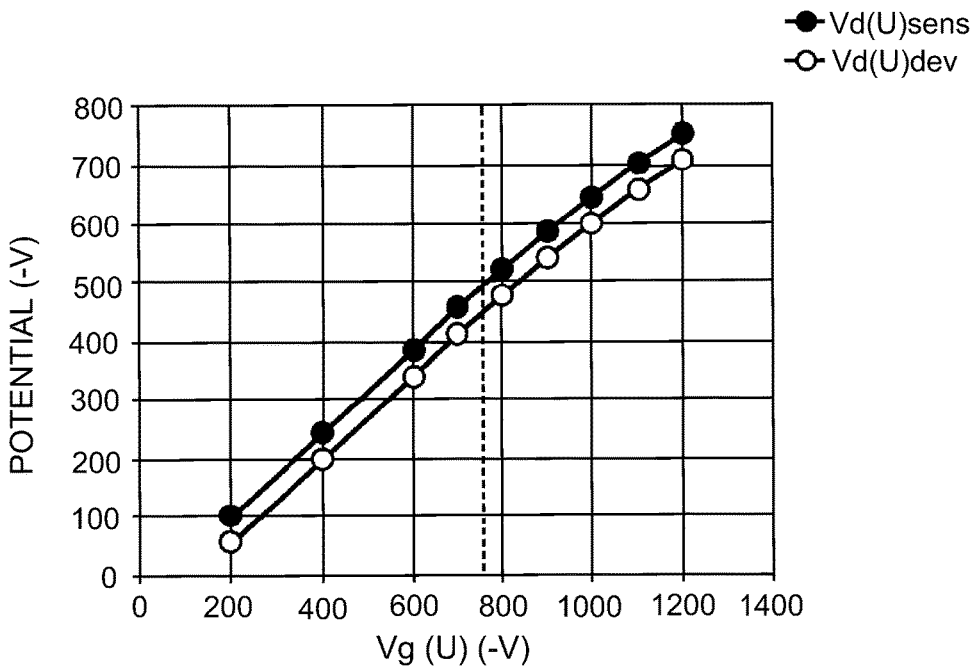

FIG. 5 is a graph for illustrating a charge potential formed by an upstream charger.

Figure 6:
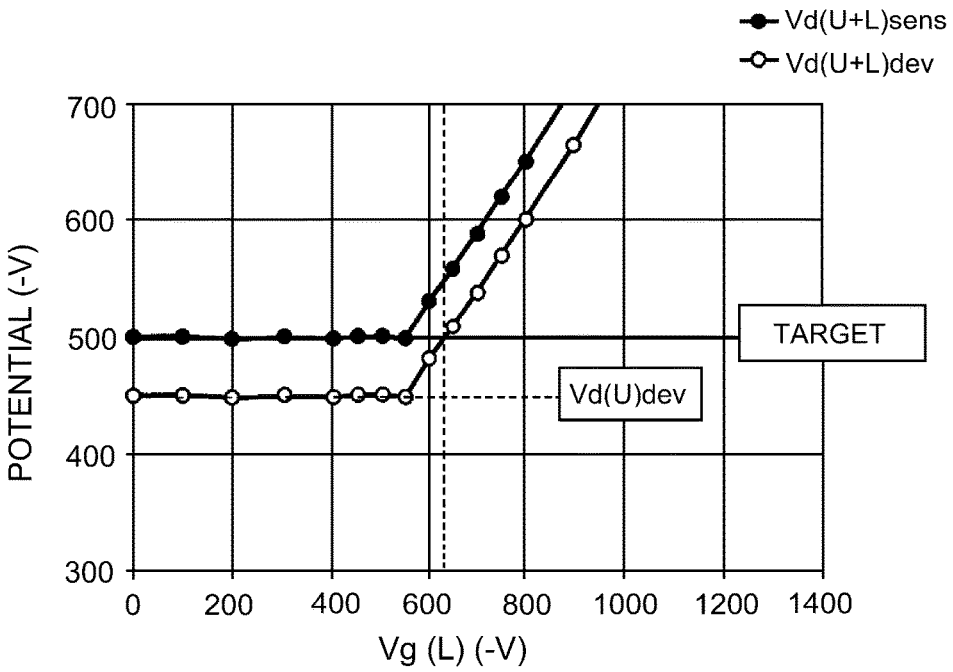

FIG. 6 is a graph for illustrating a charge potential formed by a downstream charger.

Figure 7:
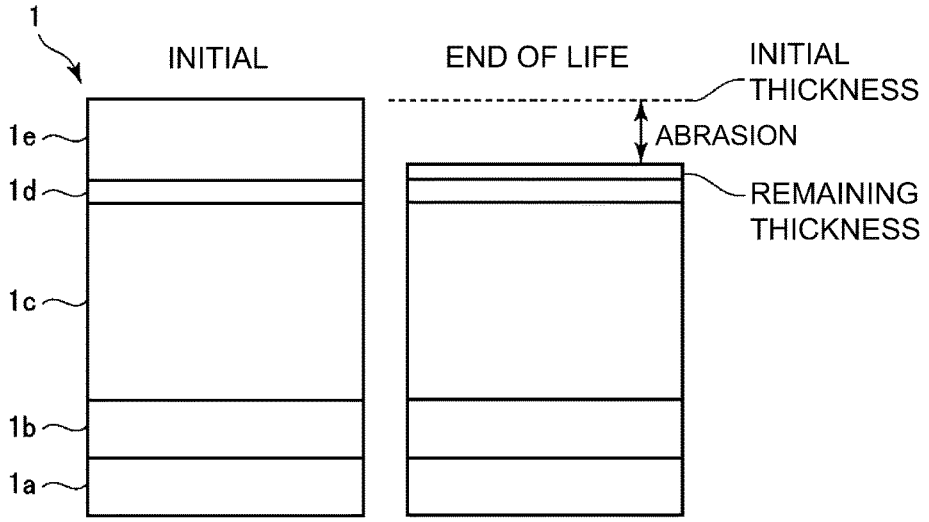

FIG. 7 is a schematic view for illustrating a change of a film thickness of a protective layer.

Figure 8:
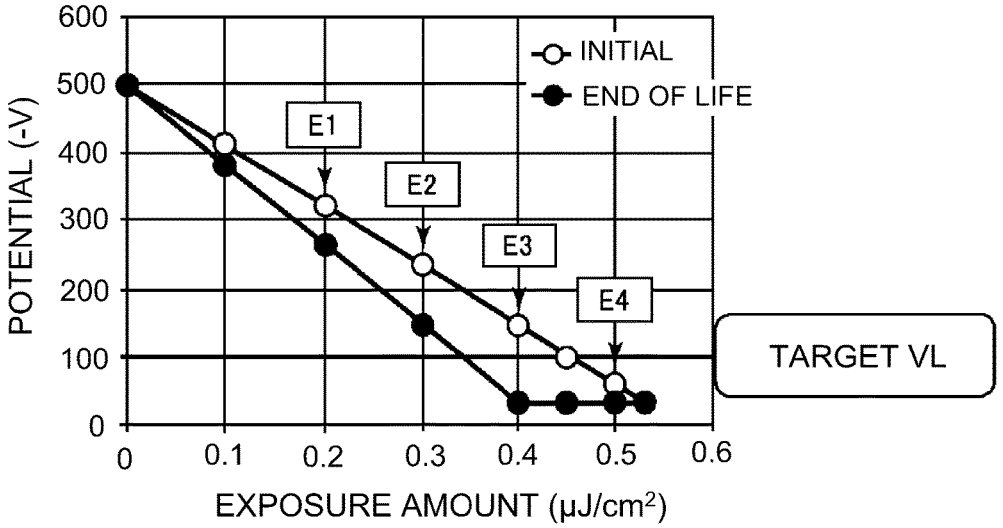

FIG. 8 is a graph for illustrating a change of an E-V characteristic of the photosensitive member.

Figure 9:
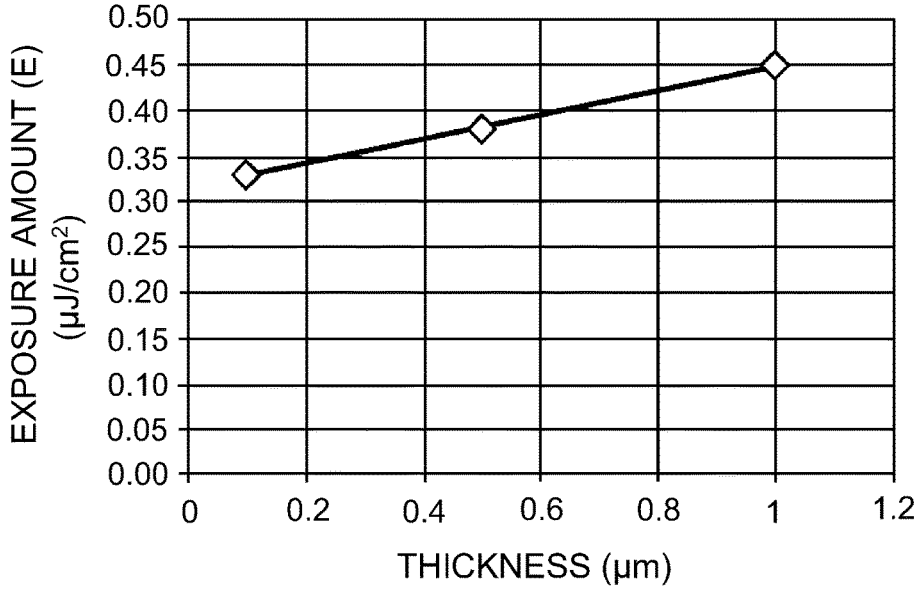

FIG. 9 is a graph showing a relationship between the film thickness of the protective layer and an exposure amount.

Figure 10:
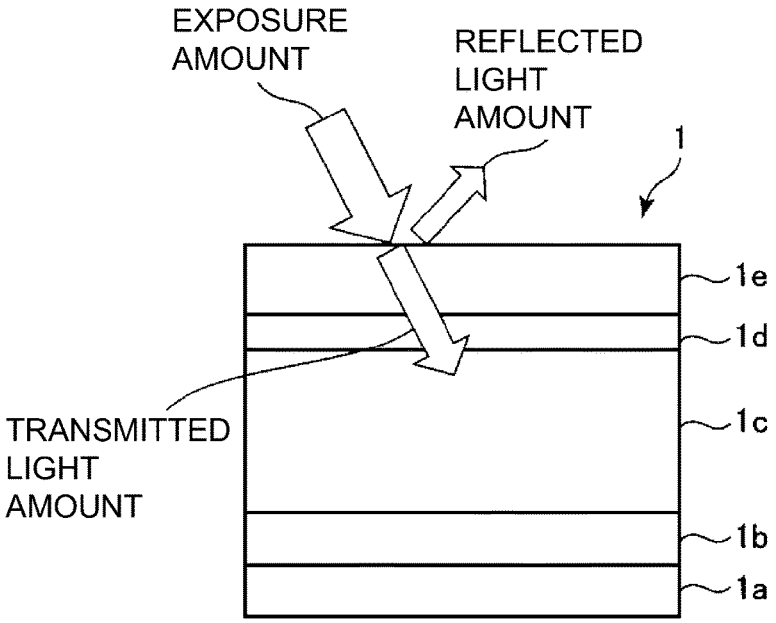

FIG. 10 is a schematic view for illustrating a relationship between the film thickness of the protective layer and a transmitted light amount.

Figure 11:
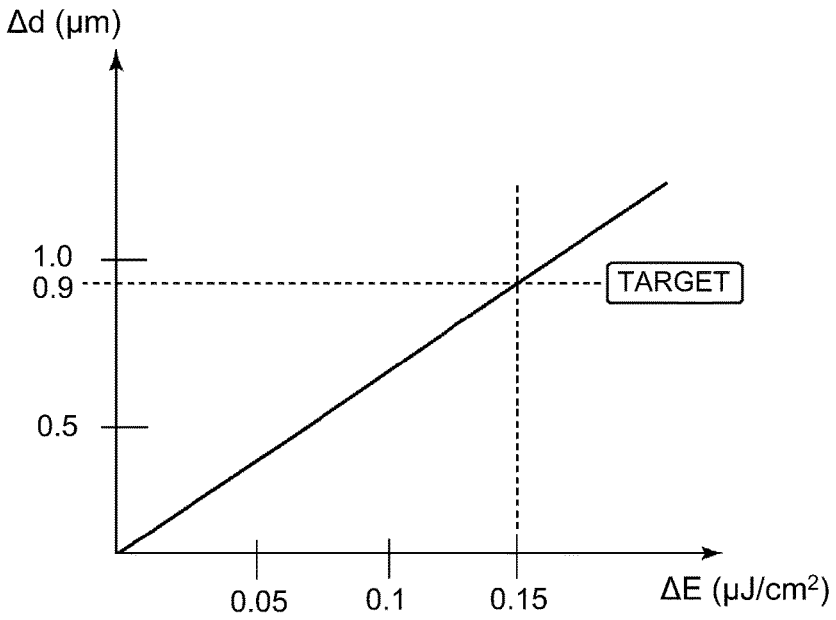

FIG. 11 is a graph showing a relationship between a change amount of the exposure amount and a change amount of the film thickness of the protective layer.

Figure 12:
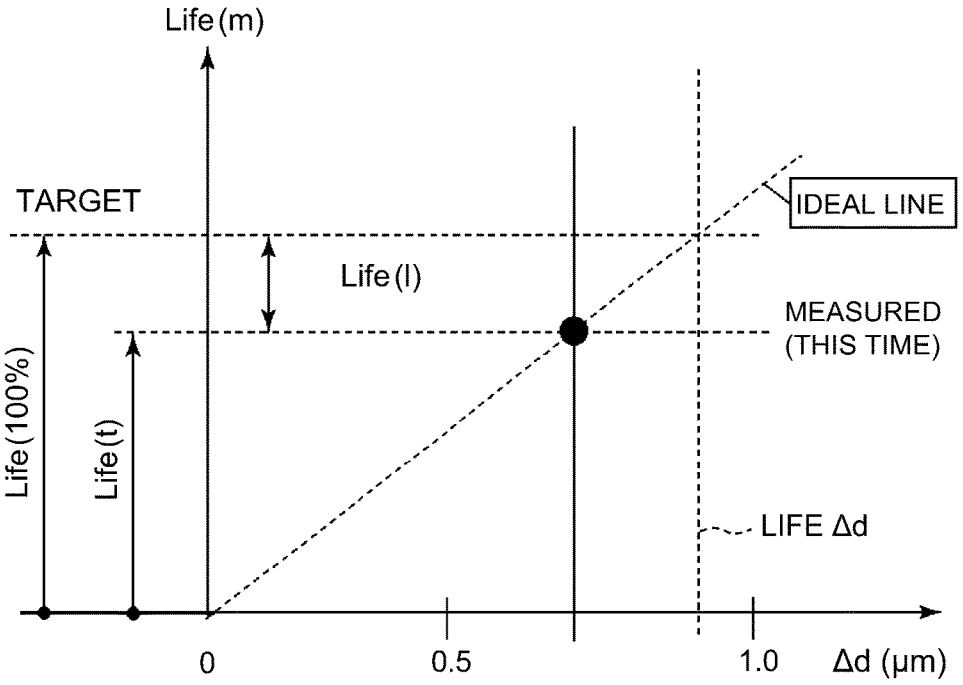

FIG. 12 is a graph for illustrating control in Embodiment 1.

Figure 13:
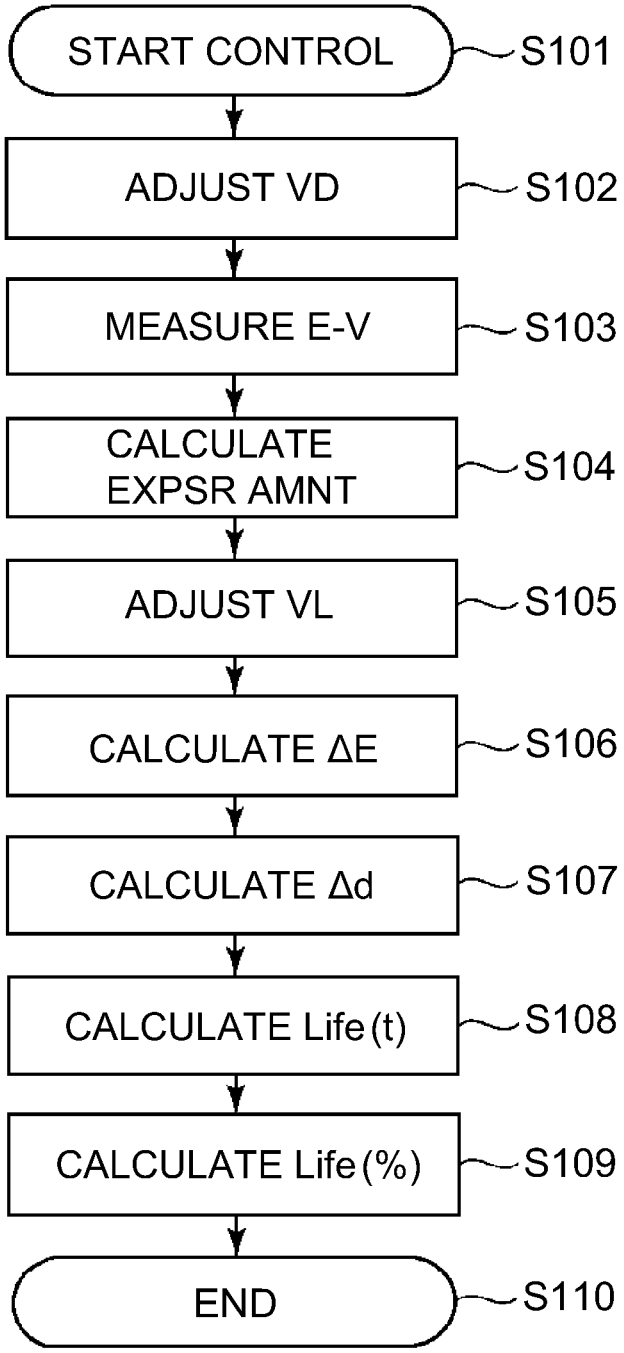

FIG. 13 is a flowchart for illustrating the control in Embodiment 1.

Figure 14:
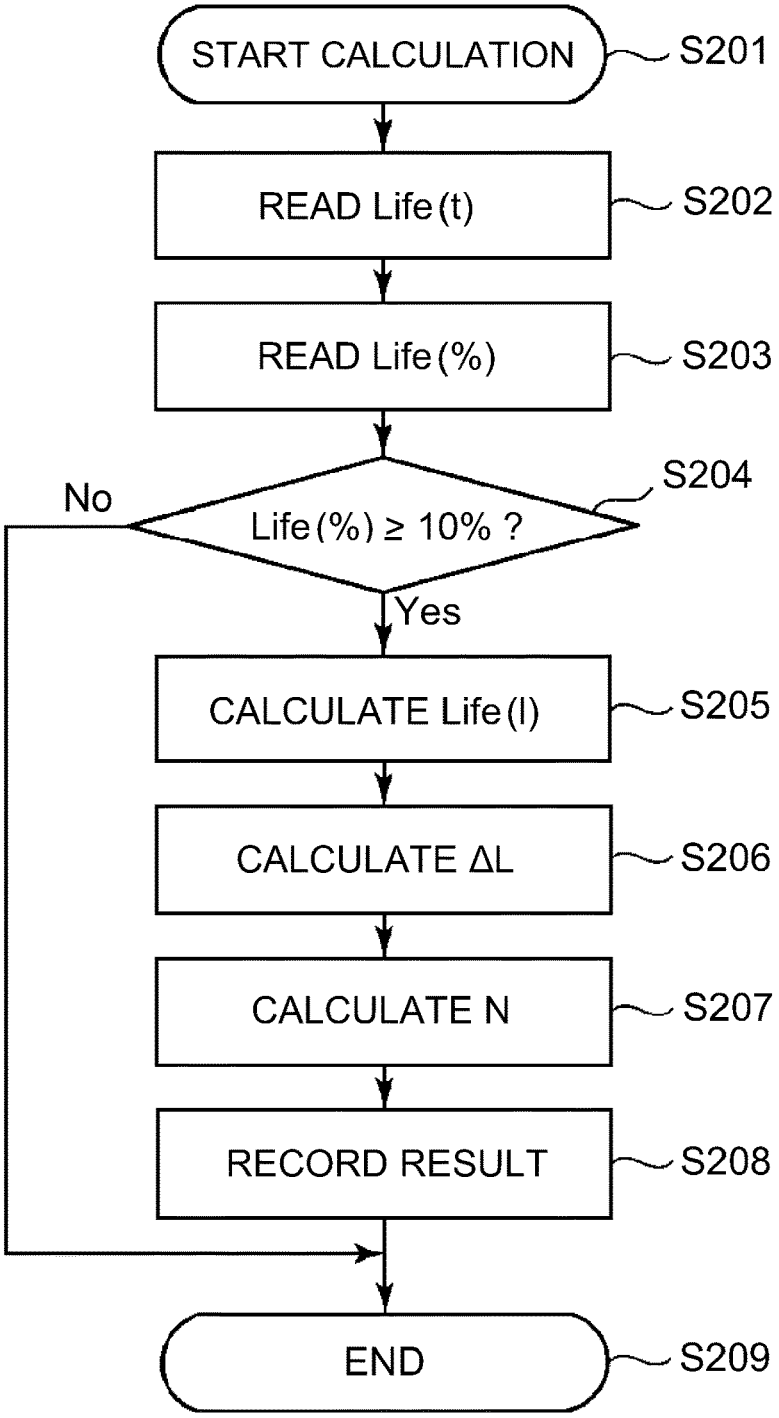

FIG. 14 is a flowchart for illustrating the control in Embodiment 1.

Figure 15:
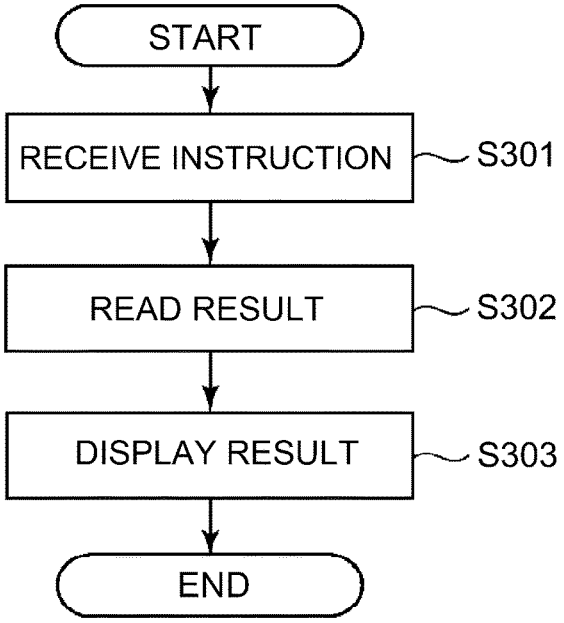
Figure 15:
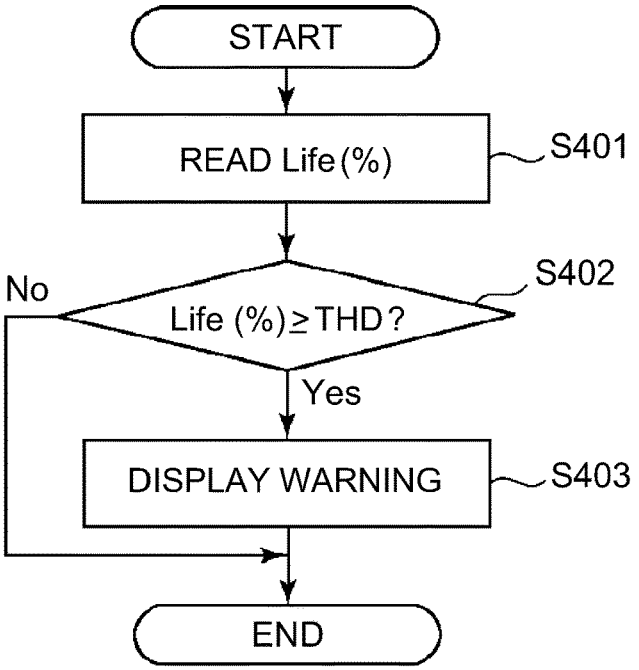

Parts (a) and (b) of FIG. 15 are flowcharts for illustrating the control in Embodiment 1.

Figure 16:
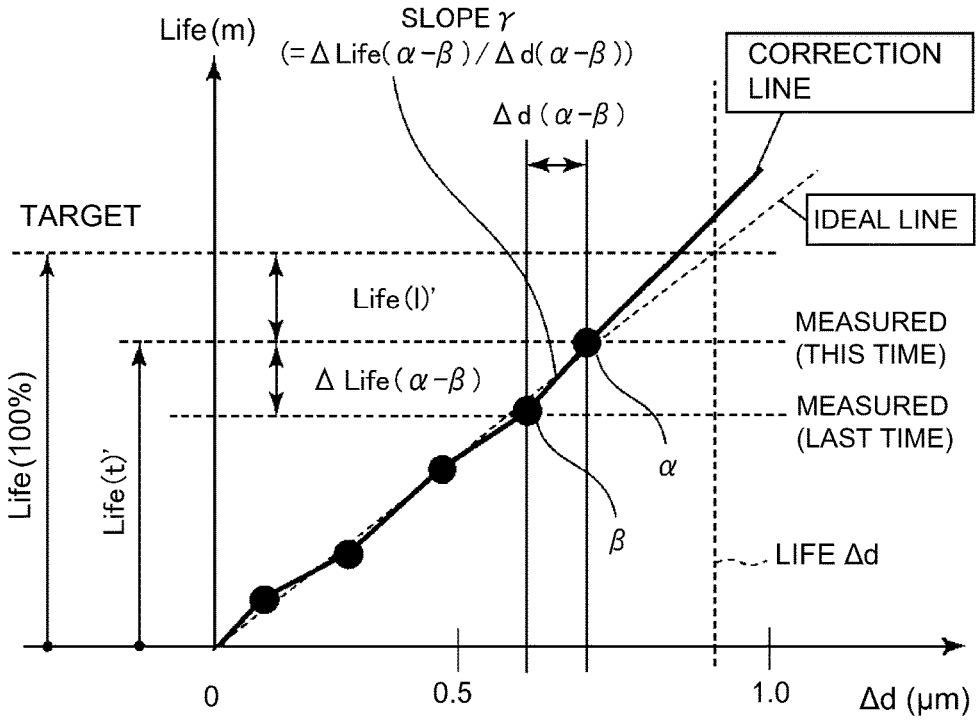

FIG. 16 is a graph for illustrating control in Embodiment 2.

Figure 17:
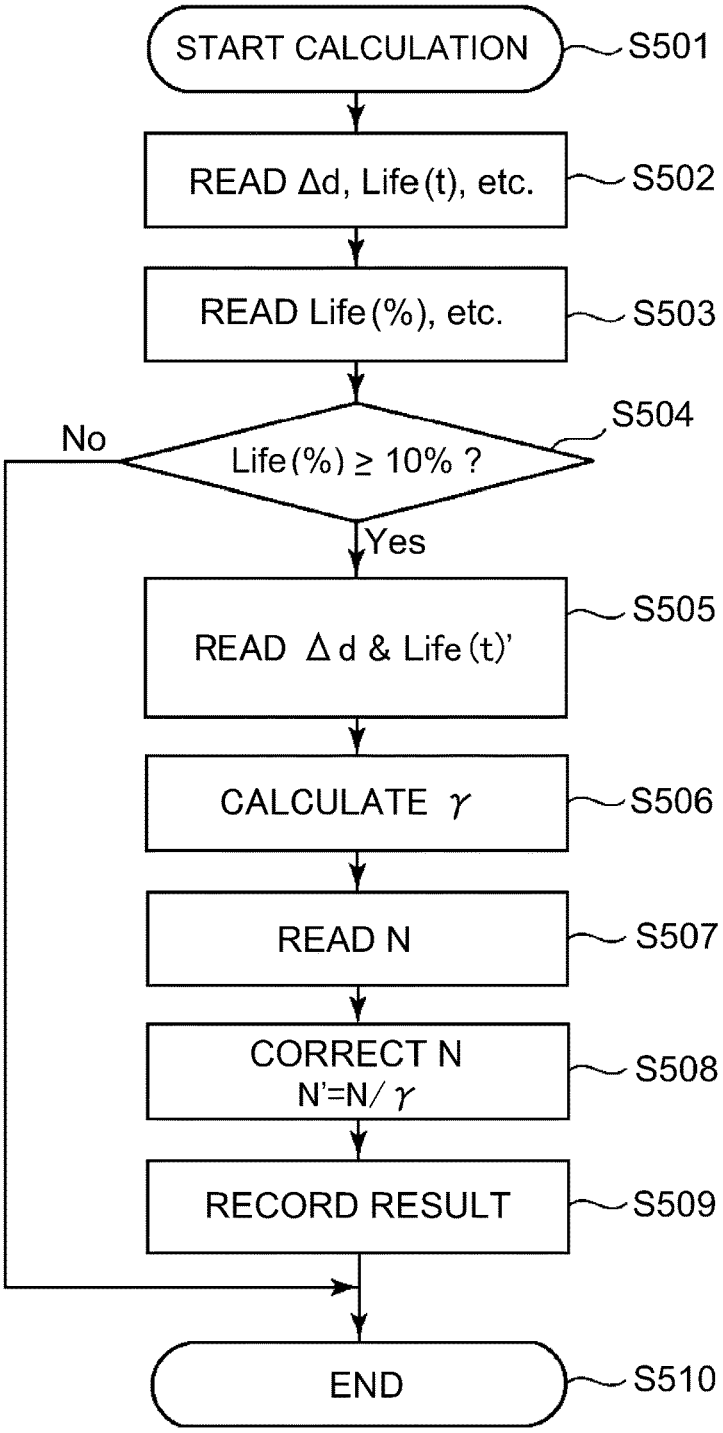

FIG. 17 is a flowchart for illustrating the control in Embodiment 2.

Figure 18:
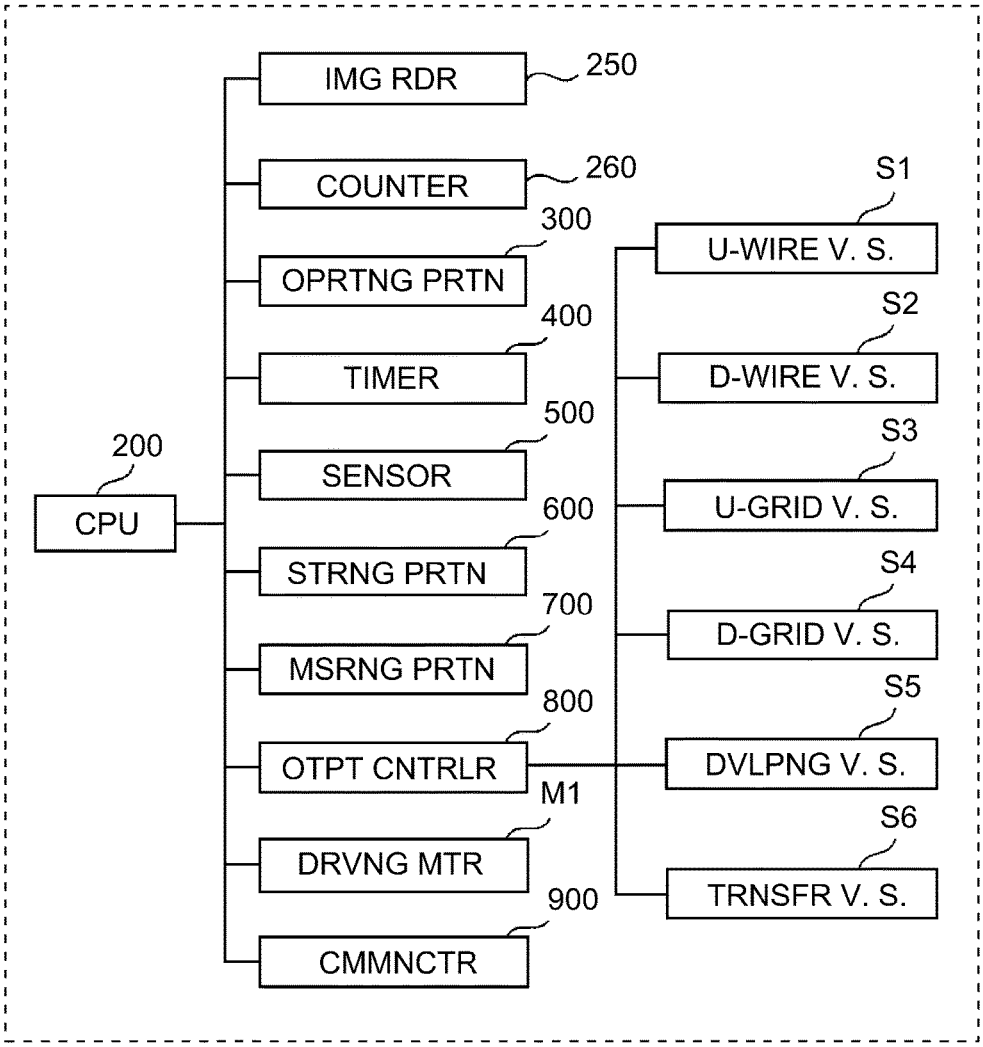

FIG. 18 is a block diagram showing a control mode of a principal part of an image forming apparatus in Embodiment 3.

Figure 19:
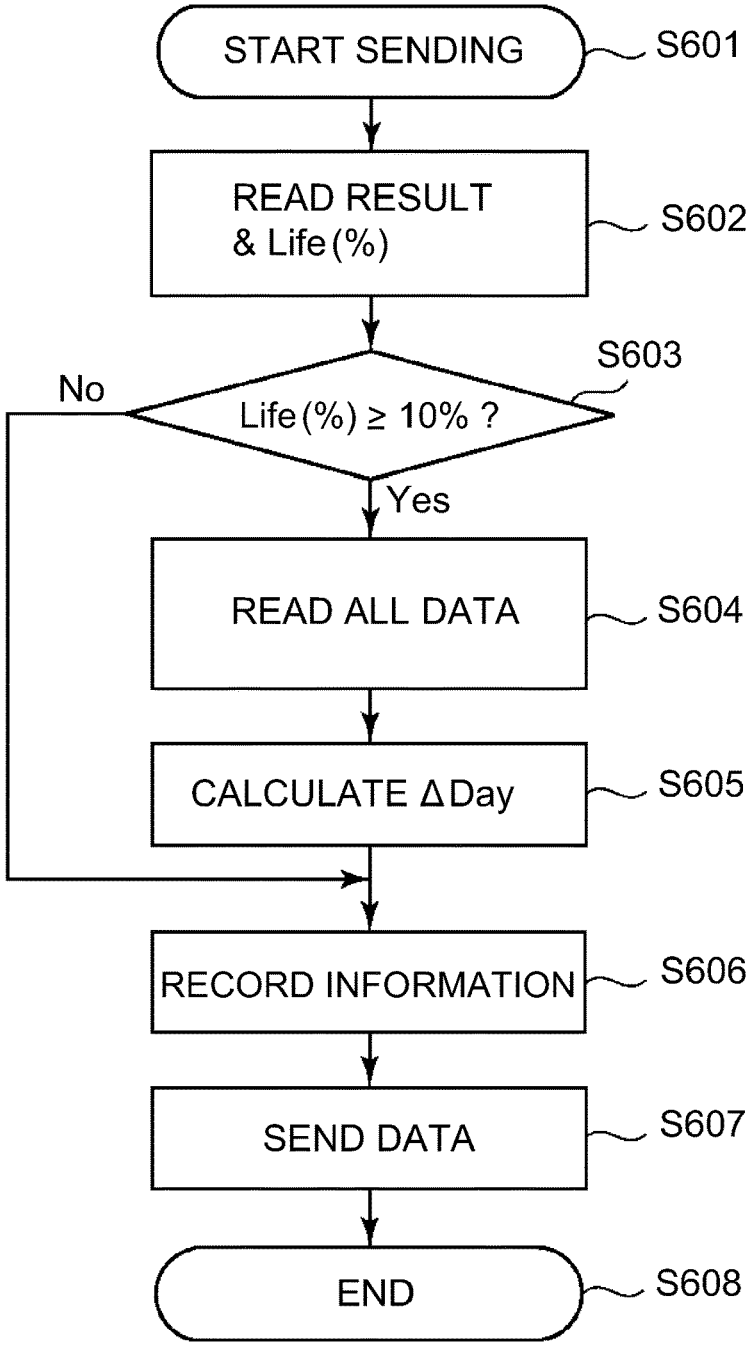

FIG. 19 is a flowchart for illustrating control in Embodiment 3.

DESCRIPTION OF EMBODIMENTS

An image forming apparatus according to the present invention will be described specifically with reference to the drawings.

Embodiment 1

<1. Image Forming Apparatus>

<1-1. General Structure and Operation of Image Forming Apparatus>

Figure 1:
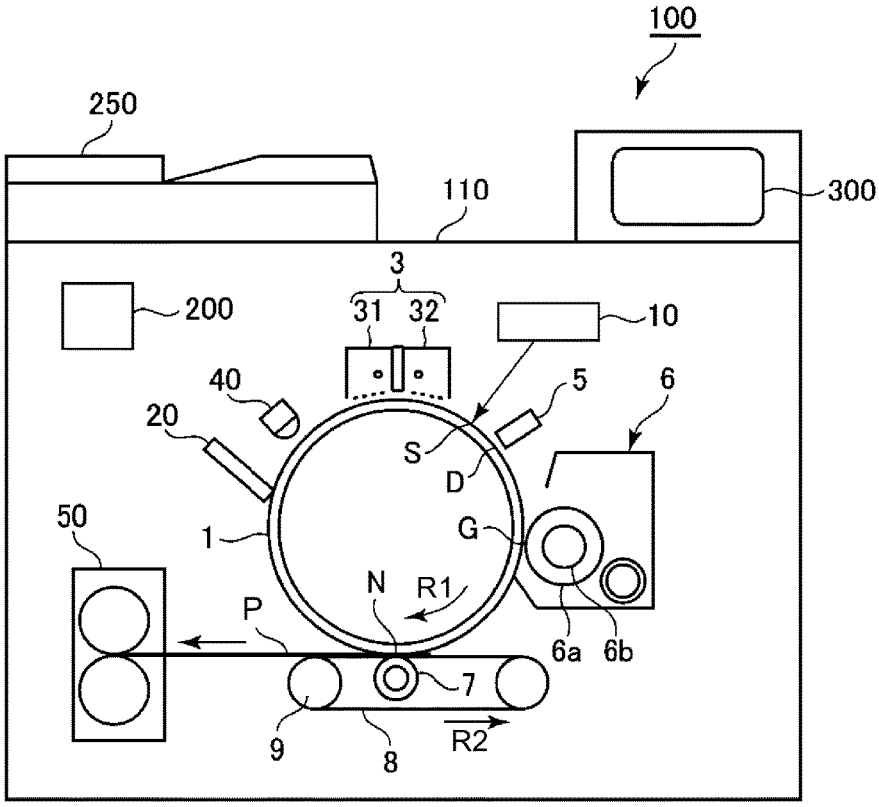
FIG. 1 is a schematic sectional view of an image forming apparatus.

FIG. 1 is a schematic sectional view of an image forming apparatus 100 in this embodiment.

The image forming apparatus 100 includes the photosensitive member 1 as an image bearing member. The photosensitive member 1 is rotationally driven in an arrow R1 direction (clockwise direction) in FIG. 1 at a predetermined peripheral speed (process speed). The surface of the rotating photosensitive member 1 is electrically charged to a predetermined polarity (negative in this embodiment) and a predetermined potential by a charging device 3 as a charging means. That is, the charging device 3 forms a charge potential (non-exposed portion potential, dark portion potential) on the surface of the photosensitive member 1. The surface of the charged photosensitive member 1 is subjected to scanning exposure to light by a display device 10 as an exposure means depending on image information, and an electrostatic image (electrostatic latent image) is formed on the photosensitive member 1. In this embodiment, a wavelength of the light emitted from the exposure device 10 is 685 nm, and an exposure amount on the surface of the photosensitive member 1 by the exposure device 10 is variable in a range of 0.1-0.5 $\mu J/cm^2$. The exposure device 10 adjusts the exposure amount depending on a developing condition, so that a predetermined exposed portion potential (light portion potential) can be formed on the surface of the photosensitive member 1.

The electrostatic image formed on the surface of the photosensitive member 1 is developed (visualized) with toner as a developer by a developing device 6 as a developing means, so that a toner image is formed on the photosensitive member 1. In this embodiment, the developing device 6 employs a two-component developing type in which a two-component developer containing a carrier (magnetic carrier particles) and toner (non-magnetic toner particles) is used as the developer. The developing device 6 includes a developing sleeve 6*a*, having a hollow cylindrical shape, as a developer carrying member and a magnet roller 6*b*, provided inside (at a hollow portion of) the developing sleeve 6*a*, as a magnetic field generating means. The developing sleeve 6*a* carries the developer by a magnetic force generated by the magnet roller 6*b* and conveys the developer to a developing position G which is an opposing portion to the photosensitive member 1. During a developing step, to the developing sleeve 6*a*, a predetermined developing voltage (developing bias) is applied from a developing voltage source (high-voltage source) circuit S5 (FIG. 4).

In this embodiment, the photosensitive member surface is exposed to light after being charged, and thus an absolute value of the charge potential of the photosensitive member 1 lowers at an exposed portion of the photosensitive member 1, so that on the exposed portion, the toner is charged to the same polarity as the charge polarity (negative in this embodiment) of the photosensitive member 1 (reverse development).

The image forming apparatus 100 includes a potential sensor 5 as a potential detecting means for detecting the surface potential of the photosensitive member 1. The potential sensor 5 is provided so as to be capable of detecting the surface potential of the photosensitive member 1 at a detecting position (sensor position) D between an exposure position S on the photosensitive member 1 by the exposure device 10 and a developing position G by the developing device 6. Control using the potential sensor 5 will be described later.

A transfer belt 8 as a recording material carrying member is provided so as to oppose the photosensitive member 1. The transfer belt 8 is wound and stretched by a plurality of stretching rollers (supporting rollers), and of these stretching rollers, a driving force is transmitted by a driving roller 9, so that the transfer belt 8 is rotated (circulated and moved) in an arrow R2 direction (counterclockwise direction) shown in FIG. 1 at a peripheral speed which is the same as the peripheral speed of the photosensitive member 1. In an inner peripheral surface side of the transfer belt 8, at a position opposing the photosensitive member 1, a transfer roller 7 which is a roller-type transfer member as a transfer means is provided. The transfer roller 7 is pressed against the transfer belt 7 toward the photosensitive member 1 and thus forms a transfer portion N where the photosensitive member 1 and the transfer belt 7 are in contact with each other. As described above, the toner image formed on the photosensitive member 1 is transferred, at the transfer portion N, onto a recording material P such as paper fed and carried by the transfer belt 8. During a transfer step, to the transfer roller 7, a transfer voltage (transfer bias) of an opposite polarity (positive in this embodiment) to a charge polarity of the toner during the development is applied from a transfer voltage source (high voltage source circuit) S6 (FIG. 4).

The recording material P on which the toner image is transferred is fed to a fixing device 50 as a fixing means and is heated and pressed by the fixing device 50, so that the toner image is fixed (melt-fixed) on the surface of the recording material P, and thereafter, the recording material P is discharged (outputted) to an outside of an apparatus main assembly 110 of the image forming apparatus 100.

On the other hand, the toner (transfer residual toner) remaining on the photosensitive member 1 after the transfer step is removed and collected from the surface of the photosensitive member 1 by a cleaning device 20 as a cleaning means. The cleaning device 20 scrapes and collects the transfer residual toner from the surface of the rotating photosensitive member 1 by a cleaning member provided in contact with the surface of the photosensitive member 1.

The surface of the photosensitive member 1 after being cleaned by the cleaning device 20 is irradiated with light (discharging light) by a light (optical)-discharging device 40 as a discharging means, so that at least a part of residual electric charges is removed. In this embodiment, the light-discharging device 40 includes an LED chip array as a light source. In this embodiment, a wavelength of the light emitted from the light-discharging device 40 is 635 nm, and an exposure amount of the surface of the photosensitive member 1 by the light-discharging device 40 is variable in a range of 1.0-7.0 $\mu mJ/cm^2$. In this embodiment, an initial value of the exposure amount by the light-discharging device 40 is set at 4.0 $\mu J/cm^2$.

Operations of the respective portions of the image forming apparatus 100 are subjected to integrated control by a CPU 200 as a controller (output portion) provided in the apparatus main assembly 110. The image forming apparatus 100 includes an operating portion 300 having a function as an input means for inputting various instructions and settings about a printing operation and a device adjusting operation and a function as a display means (notifying portion) for displaying (notifying) various pieces of information. In this embodiment, the operating portion 300 is constituted by a touch-operable screen (touch panel). The image forming apparatus 100 further includes a reading portion 250 for optically reading an image on the medium such as paper and for permitting input to the CPU 200 after converting the read image into an electric signal.

<1-2. Photosensitive Member>

Figure 2:
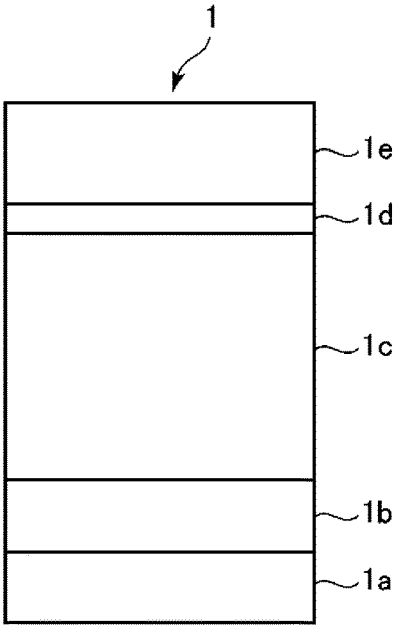
FIG. 2 is a schematic view for illustrating a layer structure of a photosensitive member.

FIG. 2 is a schematic sectional view showing a layer structure of the photosensitive member 1 in this embodiment. In this embodiment, the photosensitive member 1 is a cylindrical (drum-shaped) electrophotographic photosensitive member (photosensitive drum) and is rotatably supported by the apparatus main assembly 100, and is rotationally driven by a driving motor M1 (FIG. 4) as a driving means.

The photosensitive member 1 includes an electroconductive support 1*a* formed of aluminum or the like, and on this electroconductive support 1*a*, layers consisting of a prevention layer 1*b*, a photosensitive layer 1*c*, a prevention layer 1*d* and a protective layer 1*e* are laminated in a named order. That is, in this embodiment, the photosensitive member 1 includes the photosensitive layer 1*c* and the protective layer 1*e* provided outside the photosensitive layer 1*c*. In this embodiment, a charge polarity of the photosensitive member 1 is a negative (polarity). In this embodiment, the photosensitive member 1 is an amorphous silicon photosensitive member of 84 mm in diameter. Further, in this embodiment, the photosensitive layer 1*c* is 40 μm in film (layer) thickness and is 10 in relative dielectric constant. In this embodiment, in an initial state of use (unused state) of the photosensitive member 1, the protective layer 1*e* is 1.0 μm in film thickness (hereinafter also referred to as an initial film thickness) and 6 in relative dielectric constant. Further, in this embodiment, as regards light emitted by the exposure device 10, an optical absorption coefficient C of the protective layer 1*e* is 3000 (l/m) and a light transmittance of the protective layer 1*e* when the film thickness of the protective layer 1*e* is the initial film thickness thereof is about 70%.

Incidentally, the photosensitive member 1 in this embodiment is not a special one, but in an ordinary one used in an electrophotographic image forming apparatus as disclosed in, for example, JP-A 2014-219483. Further, the light transmittance of the protective layer 1*e* can be changed so that a proper electrostatic latent image can be formed depending on a waveform of the light emitted by the exposure device 10. Further, an electrical resistance of the protective layer 1*e* is set in a range in which isolated dots of the electrostatic latent image are stably formed, and may desirably be about $1\times10^{10}$-$1\times10^{15}$ Ω·cm. Further, the photosensitive member 1 is not limited to the above-described negatively chargeable amorphous silicon photosensitive member. For example, a material of the protective layer 1*e* may only be required to be a material suitable for the protective layer 1*e* of the photosensitive member 1, and thus an arbitrary material can be used. Further, for example, a positively chargeable amorphous silicon photosensitive member having no prevention layer 1*d* may also be used. Further, an OPC (organic photoconductor) (organic photosensitive member) having a light-transmissive protective layer 1*e* formed as an outermost surface layer of an inorganic material or the like may also be used.

<1-3. Charging Device>

Parts (a) and (b) of FIG. 3 are Schematic sectional views of the charging device 3 in this embodiment. In this embodiment, the charging device 3 is disposed above the photosensitive member 1.

As shown in part (a) of FIG. 3, the charging device 3 includes, as a plurality of corona chargers, an upstream(-side) charger (first charger) 31 provided in an upstream side with respect to a surface movement direction of the photosensitive member 1 and a downstream(-side) charger (second charger) 32 provided in a downstream side with respect to the surface movement direction. The upstream charger 31 and the downstream charger 32 are disposed adjacent to each other along the surface movement direction of the photosensitive member 1. The upstream charger 31 and the downstream charger 32 are scorotron chargers and are constituted so that charge voltages (charging biases, high charge voltages) applied thereto are independently controlled. In the following, elements relating to the upstream charger 31 and the downstream charger 32 are distinguished from each other by adding prefixes "upstream" and "downstream" in some instances.

The upstream charger 31 and the downstream charger 32 include wire electrodes (discharging wires, discharging wires) 31*a* and 32*a* as discharging electrodes, grid electrodes 31*b* and 32*b* as control electrodes, and shield electrodes 31*c* and 32*c* as shielding members (casings), respectively. Further, between the upstream charger 31 and the downstream charger 32, an insulating plate 33, which is an insulating member formed of an electrically insulating material, is provided. As a result, when different voltages are applied to the upstream shield electrode 31*c* and the downstream shield electrode 32*c*, generation of leakage between the upstream shield electrode 31*c* and the downstream shield electrode 32*c* is prevented. The insulating plate 33 is constituted by a plate-like member and is about 2 mm in thickness with respect to an adjacent direction (surface movement direction of the photosensitive member 1) between the upstream shield electrode 31*c* and the downstream shield electrode 32*c*.

A width of the charging device 3 with respect to the surface movement direction of the photosensitive member 1 is 44 mm, and a length of a discharging region (region where discharge for permitting charge of the photosensitive member 1 can be generated) of the charging device 3 with respect to a longitudinal direction (rotational axis direction) of the photosensitive member 1 is 340 mm. A width of the discharging region of each of the upstream charger 31 and the downstream charger 32 with respect to the surface movement direction of the photosensitive member 1 is 20 mm, i.e., the same.

Each of the upstream wire electrode 31*a* and the downstream wire electrode 32*a* is a wire electrode constituted by an oxidized tungsten wire. As a material of the wire electrode, a material which is 60 μm in line diameter (diameter) and which is ordinarily used in the image forming apparatus of the electrophotographic type was employed. Each of the upstream wire electrode 31*a* and the downstream wire electrode 32*a* is disposed so that an axial direction thereof is substantially parallel to the rotational axis direction of the photosensitive member 1.

Each of the upstream grid electrode 31*b* and the downstream grid electrode 32*b* is a substantially flat plate-like grid electrode which is provided with a mesh-shaped opening formed by etching and which has a substantially rectangular shape elongated in one direction. As a material of the grid electrode, a material which is prepared by forming an anti-corrosion layer such as a nickel-plated layer on SUS (stainless steel) and which is ordinarily used in the image forming apparatus of the electrophotographic type was employed. Each of the upstream grid electrode 31*b* and the downstream grid electrode 32*b* is disposed so that a longitudinal direction thereof is substantially parallel to the rotational axis direction of the photosensitive member 1. Further, as shown in part (b) of FIG. 3, each of the upstream grid electrode 31*b* and the downstream grid electrode 32*b* is disposed by changing an arrangement angle (inclination angle) so that a planar direction thereof extends along curvature of the photosensitive member 1. The arrangement angle of each of the upstream grid electrode 31*b* and the downstream grid electrode 32*b* is substantially perpendicular to a rectilinear line connecting the associated one of the upstream grid electrode 31*b* and the downstream grid electrode 32*b* with a rotation center of the photosensitive member 1. Further, each of closest distances (gaps) g between the photosensitive member 1 and the upstream grid electrode 31*b* and between the photosensitive member 1 and the downstream grid electrode 32*b* is set in a range of 1.25±0.2 mm. Further, aperture ratios of the upstream grid electrode 31*b* and the downstream grid electrode 32*b* are set at 90% and 80%, respectively. Values of the aperture ratios are not limited to those in this embodiment, but may also be appropriately changed depending on, for example, a kind, a rotational speed, a charging condition, and the like of the photosensitive member 1.

Each of the upstream shield electrode 31*c* and the downstream shield electrode 32*c* is a substantially box-like member formed of an electroconductive material and is provided with an opening at a position opposing the photosensitive member 1. The upstream grid electrode 31*b* and the downstream grid electrode 32*b* are disposed at the openings of the upstream shield electrode 31*c* and the downstream shield electrode 32*c*, respectively.

<1-4. Charge Voltage>

As shown in part (a) of FIG. 3, the upstream wire electrode 31*a* and the downstream wire electrode 32*a* are connected with an upstream wire voltage source S1 and a downstream wire voltage source S2, respectively, which are DC voltage sources (high voltage source circuits). As a result, voltages applied to the upstream wire electrode 31*a* and the downstream wire electrode 32*a* can be independently controlled. Further, the upstream grid electrode 31*b* and the downstream grid electrode 32*b* are connected with an upstream grid voltage source S3 and a downstream grid voltage source S4, respectively, which are DC voltage sources (high voltage source circuits). As a result, voltages applied to the upstream grid electrode 31*b* and the downstream grid electrode 32*b* can be independently controlled. In the following, the upstream wire voltage source S1, the downstream wire voltage source S2, the upstream grid voltage source S3 and the downstream grid voltage source S4 are collectively referred to as "charging voltage sources" in some cases. The charging voltage sources S1-S4 are examples of voltage applying means for applying voltages which can be independently controlled for the upstream charger 31 and the downstream charger 32, respectively.

The upstream shield electrode 31*c* and the downstream shield electrode 32*c* are connected with the upstream grid voltage source S3 and the downstream grid voltage source S4, respectively, and thus have the same potentials as those of the upstream grid electrode 31*b* and the downstream grid electrode 32*b*, respectively.

The upstream and downstream shield electrodes 31*c* and 32*c* are not limited to those having the same potentials as those of the upstream and downstream grid electrode 31*b* and 32*b*, respectively, but may also be electrically grounded by being connected with grounding electrodes of the apparatus main assembly 110. A constitution capable of independently controlling charge potentials formed on the surface of the photosensitive member 1 by the upstream charger 31 and the downstream charger 32 may only be required to be employed.

In this embodiment, the charging device 3 performs a charging process by forming a combined surface potential through superposition of charge potentials formed by independently controlling charging voltages applied to the upstream charger 31 and the downstream charger 32. In this embodiment, the upstream charger 31 is a main charging-side charger, and the downstream charger 32 is a potential convergence-side charger. As regards absolute values of the charge potentials of the photosensitive member 1 formed by the respective chargers, the absolute value for the upstream charger 31 is set so as to be larger than the absolute value for the downstream charger 32.

FIG. 4 is a block diagram showing a schematic control mode of a principal part of the image forming apparatus 100. To the CPU 200, a reading portion 250, a sheet number counter 260, an operating portion 300, a timer 400, an environment sensor 500, a storing portion 600, a surface potential measuring portion 700, a high voltage output controller 800 and the like are connected. The sheet number counter 260 counts the number of sheets (print number) subjected to image formation for each formation of the image on the recording material P. The timer 400 measures a time. The environment sensor 500 detects at least one of a temperature and a humidity of at least one of an inside and an outside of the apparatus main assembly 110. The surface potential measuring portion 700 is a control circuit for controlling an operation of the potential sensor 5 under control of the CPU 200. The high voltage output controller 800 is a control circuit for controlling operations of the charge voltage sources S1-S4, the developing voltage source S5 and the transfer voltage source S6 under control of the CPU 200. The storing portion 600 is a memory which is a storing means for storing programs and detection results of various detecting means, and stores, e.g., control data of the charge voltage and a measurement result of the surface potential of the photosensitive member 1. The CPU 200 carries out processes on the basis of the pieces of information from the sheet number counter 260, the timer 400, the environment sensor 500 and the storing portion 600, and provides an instruction to the high voltage output controller 800, and thus controls the charge voltage sources S1-S4.

DC voltages applied to the upstream wire electrode 31*a* and the downstream wire electrode 32*a* (hereinafter, referred to as "wire voltages" are subjected to constant-current control so that values of currents flowing through the upstream wire electrode 31*a* and the downstream wire electrode 32*a* (hereinafter, referred to as "wire currents") are substantially constant at target current values. In this embodiment, the target current value of the wire current (primary current) is changeable in a range of 0 to −3200 μA. Further, DC voltages applied to the upstream grid electrode 31*b* and the downstream grid electrode 32*b* (hereinafter, referred to as "grid voltages") are subjected to constant-voltage control so that values of the voltages are substantially constant at target voltage values. In this embodiment, the target voltage value of the grid voltage is changeable in a range of 0 to −1200 V.

<2. Control of Charge Potential>

Then, control (adjustment) of the charge potentials of the photosensitive member 1 by the charging device 3 will be further described.

As regards symbols or numerals showing the potentials, the voltages, the currents and the like, the symbols are distinguished from each other by adding "U" to the symbols relating to the upstream charger 31 and "L" to the symbols relating to the downstream charger 32, respectively, in some cases. Further, as regards the symbols showing the potentials, the potentials are distinguished from each other by adding "sens" to the symbols relating a sensor position D and "dev" to the symbols relating to the developing position G, respectively, with respect to the rotational direction of the photosensitive member 1 in some cases.

<2-1. Charge Potential by Upstream Charger>

First, control of an upstream charge potential Vd(U) which is the charge potential formed on the surface of the photosensitive member 1 by the upstream charger 31 will be described.

The upstream charge potential Vd(U) is controlled in the following manner. In a state in which an upstream wire voltage is applied to the upstream wire electrode 31*a* by the upstream wire voltage source S1 and thus a predetermined upstream wire current Ip(U) is supplied, an upstream grid voltage Vg(U) applied to the upstream grid electrode 31*b* by the upstream grid voltage source S3 is controlled (adjusted).

FIG. 5 shows a relationship of the upstream grid voltage Vg(U) with upstream charge potentials Vd(U)sens and Vd(U)dev at the sensor position D and the developing position G, respectively, in the case where the peripheral speed of the photosensitive member 1 is 700 mm/sec. As shown in FIG. 5, the upstream charge potentials Vd(U) vary depending on the upstream grid voltage Vg(U). For example, in the case where the upstream wire current Ip(U) is −1600 μA, when the upstream grid voltage Vg(U) is −750 V, the upstream charge potential Vd(U)sens at the sensor position D is −500 V, and the upstream charge potential Vd(U)dev at the developing position G is −450 V. In this embodiment, a dark decay amount of the photosensitive member 1 is about 50 V between the sensor position D and the developing position G. Accordingly, in this embodiment, in consideration of the dark decay amount of the photosensitive member 1, in order to set Vd(U)dev at a target potential (−450 V in this embodiment), the upstream grid Vg(U) is variably adjusted so that Vd(U)sens is −500 V. That is, the upstream charge potential Vd(U) and the target potential are compared with each other, and then an adjusting operation from increasing or decreasing a setting value of the upstream grid voltage Vg(U) so that the upstream charge potential Vd(U) approaches the target potential. The CPU 200 causes the storing portion 600 to store the setting value of the upstream grid voltage Vg(U) adjusted as described above, and then uses the setting value during the charging process until a subsequent adjusting operation is performed.

<2-2. Charge Potential by Downstream Charger>

Next, control of a downstream charge potential Vd(L) which is the charge potential formed on the surface of the photosensitive member 1 by the downstream charger 32 will be described. The control of the downstream charge potential Vd(L) is carried out in a state in which the upstream charge potential Vd(U) is controlled (adjusted) as described above and then the charging operation by the upstream charger 31 is continued.

The downstream charge potential Vd(L) is controlled in the following manner. In a state in which a downstream wire voltage is applied to the downstream wire electrode 32*a* by the downstream wire voltage source S2 and thus a predetermined downstream wire current Ip(L) is supplied, a downstream grid voltage Vg(L) applied to the downstream grid electrode 32*b* by the downstream grid voltage source S4 is controlled (adjusted). As a result, the downstream charger 32 forms, on the surface of the photosensitive member 1, a combined surface potential Vd(U+L) in the form of the upstream charge potential Vd(U) superposed with the downstream charge potential Vd(L).

FIG. 6 shows a relationship between the downstream grid voltage Vg(L) and the combined surface potential Vd(U+L) at the sensor position D and the developing position G in the case where the upstream charge potential Vd(U) is superposed with the downstream charge potential Vd(L). For example, in the case where the upstream charge potential Vd(U)dev at the developing position G is −450 V, when the downstream wire current Ip(L) is −1600 μA and the downstream grid voltage Vg(L) is −620 V, the combined surface potentials are as follows. That is, the combined surface potential Vd(U+L)sens at the sensor position D is −550 V, and the combined surface potential Vd(U+L)dev at the developing position G is −500 V.

In this embodiment, in consideration of the dark decay amount of the photosensitive member 1, in order to set Vd(U+L)dev at a target potential (−500 V in this embodiment), the downstream grid Vg(L) is variably adjusted so that Vd(U+L)sens is −550 V. That is, the combined surface potential Vd(U+L) and the target potential are compared with each other, and then an adjusting operation from increasing or decreasing a setting value of the downstream grid voltage Vg(L) so that the combined surface potential Vd(U+L) approaches the target potential. The CPU 200 causes the storing portion 600 to store the setting value of the downstream grid voltage Vg(L) adjusted as described above, and then uses the setting value during the charging process until a subsequent adjusting operation is performed.

In this embodiment, the combined surface potential Vd(U+L) formed on the photosensitive member 1 as described above is simply referred to as a "charge potential VD".

In this embodiment, control of the charge potential VD (specifically, adjustment of the setting values of the upstream grid voltage Vd(U) and the downstream grid voltage Vg(L)) is carried out at predetermined timing during non-image formation. In this embodiment, as the predetermined timing, the control of the charge potential VD is carried out in the case where an integrated print number (sheet number) counted by the sheet number counter 260 reaches 5000 sheets, during actuation of the image forming apparatus and in the case where an environmental fluctuation of a predetermined value or more is detected by the environment sensor 500. Incidentally, "during non-image formation" is a period other than during an image forming operation (printing operation) for performing the formation of the image to be transferred and outputted on the recording material P. As during non-image formation, it is possible to cite during a pre-multi-rotation operation, during a pre-rotation operation, during a sheet interval, during a post-rotation operation and the like. The pre-multi-rotation operation is a preparatory operation during main switch actuation of the image forming apparatus 100 or during restoration of the image forming apparatus 100 from a sleep state. The pre-rotation operation is an operation performed in a period, from input of an instruction of a start of a job until the image formation is actually started, in which a preparatory operation in advance of the image forming operation is carried out. The sheet interval is a period corresponding to an interval between a recording material P and a subsequent recording material P when images are continuously formed on a plurality of recording materials P (continuous image formation). The post-rotation operation is an operation performed in a period in which a post-operation (preparatory operation) after the image forming operation is carried out. Thus, the control of the charge potential VD is typically carried out automatically by the CPU 200, but may also be constituted so that the CPU 200 can carry out the control of the charge potential VD in response to an instruction from an operator through the operating portion 300. The job is a series of operations, started by a single start instruction, for forming and outputting the image(s) on a single recording material P or on the plurality of recording materials P.

<3. Control of Exposed Portion Potential>

Next, control (adjustment) of the exposed portion potential VL of the photosensitive member 1 by the exposure device 10 will be described.

In this embodiment, as described above, in a state in which the charge potential VD is controlled (adjusted) and the charging operation by the charging device 3 is continued, the exposure amount of the surface of the photosensitive member 1 by the exposure device 10 is controlled (adjusted), so that the exposed portion potential VL is controlled (adjusted). The exposure amount is represented by an amount (quantity) of light emitted per unit area of the photosensitive member 1 and per unit time (unit: $\mu J/cm^2$).

FIG. 8 is a graph showing a relationship between the exposed portion potential VL and the exposure amount acquired during the control of the exposed portion potential VL. The exposed portion potential VL is detected at the sensor position D, but is shown as a value at the developing position G in consideration of the dark decay amount. During the control of the exposed portion potential VL, a region of the charge potential VD formed on the photosensitive member 1 is exposed to light with a plurality of different exposure amounts, so that a plurality of different exposed portion potentials VL are formed. In this embodiment, during the control of the exposed portion potential VL, the photosensitive member 1 is exposed to light with exposure amounts of 4 levels indicated by E1 to E4 in FIG. 8. Then, exposed portion potentials VL formed with the respective exposure amounts are detected by the potential sensor 5 and are associated with the respective exposure amounts, and are stored in the storing portion 600. On the basis of an acquired relationship between the exposure amount and the exposed portion potential VL (hereinafter also referred to as an "E-V" characteristic, the CPU 200 acquires an exposure amount for providing an exposed portion potential as a target potential. In this embodiment, the exposure amount is variably adjusted so that the light portion potential VL at the sensor position D becomes a corresponding value in consideration of the decay amount and thus so that the exposed portion potential VL at the developing position G is the target potential (−100 V in this embodiment). The CPU 200 causes the storing portion 600 to store a setting value of the exposure amount adjusted as described above, and uses the setting value during an exposure operation until a subsequent adjustment is carried out.

In this embodiment, the above-described control of the exposed portion potential VL (i.e., the adjustment of the setting value of the exposure amount of the exposure device 10) is carried out at predetermined timing during non-image formation. Particularly, in this embodiment, the control of the exposed portion potential VL is carried out every execution of the above-described control of the charge potential VD (i.e., the adjustment of the setting values of the upstream grid voltage Vg(U) and the downstream grid voltage Vg(L)).

<4. Relationship Between Film Thickness of Protective Layer and Sensitivity Characteristic>

Next, a relationship between the film thickness of the protective layer of the photosensitive member 1 and a sensitivity characteristic of the photosensitive member 1 will be described.

<4-1. Change of E-V Characteristic of Photosensitive Member>

First, a change of the E-V characteristic due to an increase of an amount of use of the photosensitive member 1 will be described. FIG. 7 is a schematic sectional view showing a difference in film thickness of the protective layer 1*e* between an initial state of use of the photosensitive member 1 and when the photosensitive member 1 reaches an end of a lifetime thereof. FIG. 8 shows an E-V characteristic measured during the above-described control of the exposed portion potential VL in each of the initial state of use of the photosensitive member 1 and when the photosensitive member 1 reaches the end of its lifetime. In FIG. 8, "○" represents the E-V characteristic when the film thickness of the protective layer 1*e* is 1.0 mm which is an initial film thickness, and "●" represents the E-V characteristic when the film thickness of the protective layer 1*e* decreases and reaches 0.1 μm which is a predetermined film thickness set as the (end of) lifetime of the photosensitive member 1 in this embodiment.

As shown in FIG. 8, the exposure amount necessary to control the exposed portion potential VL to −100 V which is the target potential (hereinafter this exposure amount is referred to as a "necessary exposure amount") is smaller when the photosensitive member 1 reaches the end of its lifetime than in the initial state of use of the photosensitive member 1.

<4-2. Relationship Between Film Thickness of Protective Layer and Necessary Exposure Amount>

Next, a relationship between the film thickness of the protective layer 1*e* and the necessary exposure amount will be described. FIG. 9 is a graph showing the relationship between the film thickness of the protective layer 1*e* and the necessary exposure amount.

As shown in FIG. 9, the film thickness of the protective layer 1*e* and the necessary exposure amount are proportional to each other. This is because a relationship between the necessary exposure amount and an incident light amount (quantity) is the following relationship.

FIG. 10 is a schematic model view showing a state in which light incident on the surface of the photosensitive member 1 passes through the protective layer 1*e* and reaches the photosensitive layer 1*c*. A transmitted light amount τ of the light passing through the protective layer 1*e* can be generally represented by the following formula (1).

$$\tau = \mathrm{EXP}(-cxd) \quad (1)$$

In the formula (1), C is a light absorption coefficient, and d is the film thickness of the protective layer 1*e*. The formula (1) shows that the transmitted light amount τ is proportional to the film thickness d.

In this embodiment, by using the change of the necessary exposure amount depending on the film thickness of the protective layer 1*e* as described above, information on a change amount of the film thickness of the protective layer 1*e* is acquired on the basis of the necessary exposure amount measured in the image forming apparatus 100. That is, in this embodiment, a predetermined charge potential VD is formed on the photosensitive member 1. The necessary exposure amount which is an exposure amount, of the exposure device 10, for changing a potential in the region of the predetermined charge potential VD to the exposed portion potential VL is acquired. Specifically, the region of the predetermined charge potential VD is exposed to light with a plurality of different exposure amounts to acquire an E-V characteristic, and from the E-V characteristic, the necessary exposure amount for changing the exposed portion potential VL to the predetermined exposed portion potential VL is acquired. Then, in this embodiment, from information on a change amount, of the necessary exposure amount, which is a difference between the necessary exposure amount in the initial state of use and a current necessary exposure amount, information on a change amount, of the film thickness of the protective layer 1*e*, which is a difference between the film thickness of the protective layer 1*e* in the initial state of use and a current film thickness of the protective layer 1*e*, is acquired. In other words, the information on the change amount of the necessary exposure amount is acquired by measuring the change of the E-V characteristic, and on the basis of the acquired information on the change amount of the necessary exposure amount, the information on the change amount of the film thickness of the protective layer 1*e* is acquired. Further, in this embodiment, on the basis of the information on the change amount of the film thickness of the protective layer 1*e*, information on the (end of) lifetime of the photosensitive member 1 is acquired. In this embodiment, acquirement of the information on the change amount of the film thickness of the protective layer 1*e* and acquirement of the information on the lifetime of the photosensitive member 1 are carried out every execution of the above-described control (adjustment) of the charge potential VD and the above-described control (adjustment) of the exposed portion potential VL (hereinafter these pieces of the control are also simply referred to as "potential control"). That is, in this embodiment, when the adjustment of the charge potential and the exposed portion potential of the photosensitive member 1 is carried out, the CPU 200 carries out also a process for acquiring the information on the lifetime of the photosensitive member 1 in combination.

In this embodiment, the predetermined exposed portion potential VL is used for measurement of the film thickness of the protective layer 1*e* was set at −100 V which is the target potential of the exposed portion potential VL for image formation, but is not limited thereto. As regards the exposed portion potential VL used for measurement of the film thickness of the protective layer 1*e*, any potential can be selected when the potential satisfies the following condition. That is, the exposed portion potential VL may only be required to be in a region in which the E-V characteristic is changed by the change of the transmitted light amount of the light from the exposure device 10 due to the above-described change of the film thickness of the protective layer 1*e*. However, when a slope of a change of an absolute value of the exposed portion potential VL relative to the change of the exposure amount is α (=ABS(ΔVL/ΔE)), the exposed portion potential VL used for measurement of the film thickness of the protective layer 1*e* may desirably be set in a range of α>0. This is because for example, even in the E-V characteristic when the photosensitive member 1 reaches the lifetime, the exposed portion potential VL used for measurement of the film thickness of the protective layer 1*e* is set in the region in which the exposed portion potential VL changes relative to the change of the exposure amount. Further, a potential difference between the charge potential VD and the exposed portion potential VL used for measurement of the film thickness of the protective layer 1*e* may desirably be sufficiently increased so that the change of the E-V characteristic due to the change of the film thickness of the protective layer 1*e* can be measured with desired accuracy. Typically, the exposed portion potential VL used for measurement of the film thickness of the protective layer 1*e* may only be required to be made equal to the target potential of the exposed portion potential VL for image formation as in this embodiment, but may also be larger or smaller than the target potential.

Here, the method in this embodiment is effective in the case where the photosensitive member including the light-transmissive protective layer at the outer peripheral surface (outermost surface layer) of the photosensitive layer (single or plurality of layers having the charge generating function and the charge transporting function). Conversely, the method in this embodiment is not effective in the case where the protective layer is not provided as the outermost surface layer. This is because the change of the photosensitive member in which the protective layer is not provided as the outermost surface layer and in which the outermost surface layer is the photosensitive layer (the photosensitive layer having the charge generating function and the charge transporting function in the case of the single layer structure or the charge transporting layer in the case of the lamination layer structure) also generates a change of a sensitivity characteristic with a change of electrostatic capacity. When the electrostatic capacity changes, also a change of a surface charge amount for forming the predetermined charge potential VD and a change of a potential decay characteristic (dark decay, light decay) are included in the change of E-V characteristic. For that reason, in some cases, measurement accuracy of the film thickness becomes insufficient by measuring only the change amount of the exposed portion potential VL as in this embodiment. For example, there is a case that the sensitivity of the photosensitive member becomes poor due to a decrease of the film thickness and thus the predetermined exposed portion potential VL cannot be measured within a range of the exposure amount of the exposure device. For that reason, in the case where the photosensitive member in which the outermost surface layer thereof is the photosensitive layer, the methods as disclosed in JP-A 2005-283736 and JP-A 2003-195701 are used.

<5. Amount of Use and Lifetime of Photosensitive Member>

Next, on the basis of a change amount Δd, of the film thickness of the protective layer 1*e*, acquired from a measurement result of a change amount ΔE of the necessary exposure amount, the method of acquiring the information on the amount of use of the photosensitive member 1 and the information on the lifetime of the photosensitive member 1 will be further described specifically.

(5-1. Relationship Between Necessary Exposure Amount and Change Amount of Film Thickness of Protective Layer>

FIG. 11 is a graph showing the relationship between the change amount ΔE of the necessary exposure amount from the initial state of use of the photosensitive member 1 and the change amount Δd of the film thickness of the photosensitive member 1 from the initial state of use of the photosensitive member 1. As shown in FIG. 11, ΔE and Δd are proportional to each other. In this embodiment, in the case where ΔE reaches 0.15 ($\mu J/cm^2$), Δd reaches 0.9 μm, and setting is made such that the photosensitive member 1 reaches the end of the lifetime thereof at this time.

Incidentally, values of ΔE and Δd are not limited to those in this embodiment, but can be appropriately changed depending on conditions such as the sensitivity characteristic of the photosensitive member 1, the film thickness of the protective layer 1*e* and a remaining film thickness, of the protective layer 1*e*, necessary when the photosensitive member 1 reaches the end of the lifetime thereof.

<5-2. Amount of Use and Lifetime of Photosensitive Member>

FIG. 12 is a graph showing a relationship between the change amount Δd of the film thickness of the protective layer 1*e* from the initial state of use of the photosensitive member 1 and the amount of use of the photosensitive member 1 from the initial state of use of the photosensitive member 1. In FIG. 12, the abscissa represents Δd, and the ordinate represents the amount of use of the photosensitive member 1. In this embodiment, the amount of use of the photosensitive member 1 is represented by a travel (movement) distance (m) of the photosensitive member 1.

As described above, in this embodiment, the setting is made such that the photosensitive member 1 reaches the end of the lifetime thereof in the case where the change amount Δd of the film thickness of the protective layer 1*e* reaches 0.9 μm. The amount of use set as the lifetime of the photosensitive member 1 is also referred to as a "target lifetime value Life(100%)". Further, the amount of use at execution timing (acquiring timing of the information on Δd) of each of pieces of potential control is also referred to as a "real time amount of use Life(t)".

In this embodiment, during the potential control executed at a predetermined interval (frequency), on the basis of the relationship between ΔE and Δd shown in FIG. 11, the change amount Δd of the film thickness of the protective layer 1*e* from the initial state of use of the photosensitive member 1 is acquired. Further, on the basis of this Δd, the real time amount of use Life(t) which is the amount of use of the photosensitive member 1 from the initial state of use to this time (present time). In this embodiment, this Life(t) is acquired from a lifetime ratio Life(%) of the of the photosensitive member 1 and the target lifetime value Life (100%) on an ideal line described later. The lifetime ratio Life(%) of the photosensitive member 1 is acquired as a ratio of a current Δd to Δd (0.9 μm in this embodiment) set as the lifetime of the photosensitive member 1 (i.e., Δd=(current Δd)/(Δd at time of end of lifetime)). That is, in this embodiment, the real time amount of use Life(t) is acquired by the following formula (see also formula (4) appearing hereinafter).

$$\text{Life}(t)=\text{Life}(100\%)\times\text{Life}(\%)$$

Then, from the acquired real time amount of use Life(t) and the target lifetime value Life(100%), a remaining lifetime Life(l) which is a usable amount (travelable (movable) distance) of the photosensitive member 1 from now (this time) until the photosensitive member 1 reaches the end of the lifetime thereof is acquired.

<5-3. Calculating Method of Amount of Use of Photosensitive Member>

Next, a calculating method of the amount of use of the photosensitive member 1 on the ideal line shown in FIG. 12 will be described using the following formulas (2), (3) and (4).

$$\text{Life}(t)=A\times PS\times tc+B\times PS\times t \quad (2)$$

$$\text{Life}(100\%)=C\times PS\times t(\text{end}) \quad (3)$$

$$\text{Life}(100(\%)=\{\text{Life}(t)/\text{Life}(100\%)\}\times 100 \quad (4)$$

First, the formula (2) will be described. The formula (2) is a formula for converting, into the travel distance of the photosensitive member 1, the amount of use of the photosensitive member 1, from the initial state of use to the present time, determined by printing hysteresis of the photosensitive member 1 from the initial state of use to the present time. In the formula (2), tc is a charging time (time in which the charging process of the photosensitive member 1 is performed by the charging device 3) (hours), and t is a driving time (time in which the photosensitive member 1 rotates) (hour(s)). Further, a coefficient A is a coefficient showing a ratio of an abrasion amount of the photosensitive member 1 to the charging time (hours), and a coefficient B is a coefficient showing a ratio of the abrasion amount of the photosensitive member 1 to the driving time (hour(s)) of the photosensitive member 1. Further, PS is a peripheral speed (mm/sec) of the photosensitive member 1. In this embodiment, a value of the coefficient A is 0.9, and a value of the coefficient B is 0.1.

Next, the formula (3) will be described. The formula (3) is a formula for calculating the target lifetime value. In the formula (3), t(end) shows a time required for printing images on a target print number of sheets in continuous printing. A coefficient C is a coefficient which is used in the case where the target print number of sheets in intermittent printing is set and which shows a ratio of travel distance of the photosensitive member 1 between a continuous condition (operation) and a predetermined intermittent operation. In this embodiment, the lifetime of the photosensitive member 1 is set on the basis of the condition of the continuous printing, and therefore, a value of the coefficient C is 1. In this embodiment, t(end) is set at 600 hours. This is because a printing speed of the image forming apparatus 100 is 10000 sheets/hour in the case of the continuous printing of A4-sized sheets, and therefore, the lifetime (the print number of sheets on an A4-size basis until the change amount Δd of the protective layer 1*e* reaches 0.9 μm) is 6000 K ($6000\times10^3$) sheets.

Next, the formula (4) will be described. The formula (4) is a formula for calculating the lifetime ratio Life(%) as a ratio of the real time amount of use Life(t) to the target lifetime value Life(100%).

A rectilinear line, showing a relationship between Δd and the amount of use of the photosensitive member 1, which is drawn so that the amount of use, of the photosensitive member 1, represented by the above-described formulas (2) to (4) and the change amount Δd of the film thickness of the protective layer 1*e* are proportional to each other is the ideal line shown in FIG. 12.

Incidentally, numerical values used as the values of the coefficients in the above-described formulas (2) and (3) and used for defining the setting of the lifetime of the photosensitive member 1 can be changed appropriately depending on the structure of the photosensitive member 1 and a setting condition of the lifetime of the photosensitive member 1.

In accordance with the above-described formula (2), the real time amount of use Life(t) can be acquired from the charging time tc measured by the timer 400 and the driving time t of the photosensitive member 1. Then, the lifetime ratio Life(%) can be obtained from the acquired real time amount of use Life(t) and the target lifetime value Life (100%) which is represented by the above-described formula (3) and which is set in advance. However, the lifetime ratio Life(%) on the basis of the real time amount of use Life(t) calculated in accordance with the above-described formula (2) is a predicted value in an ideal state such that the film thickness of the protective layer 1*e* decreases in a predetermined proportion in accordance with the information (charging time, driving time) on the time in which the photosensitive member 1 is used. However, the abrasion amount of the protective layer 1*e* fluctuates in some cases by the influence of a status of use (use operation) environment, image forming condition, change of a frictional force of the cleaning member, and the like) of the image forming apparatus 100. Therefore, in this embodiment, as described above, on the basis of the change amount Δd of the film thickness of the protective layer 1*e* acquired on the basis of the E-V characteristic measured during the potential control, the real time amount of use Life(t), the lifetime ratio Life(%) and the remaining lifetime Life(l) described later are acquired. As a result, on the basis of an actual abrasion amount of the protective layer 1*e*, the amount of use of the photosensitive member 1 and the time when the photosensitive member 1 reaches the end of its lifetime can be acquired with high accuracy. Incidentally, a method of correcting the predicted value of the lifetime of the photosensitive member 1 by using the real time amount of use Life(t) calculated on the basis of the time of use of the photosensitive member 1 in accordance with the above-described formula (2) will be described in Embodiment 2 appearing hereinafter.

<5-4. Prediction of Lifetime of Photosensitive Member>

A calculating method of the predicted value (lifetime (end) arrival timing) of the lifetime of the photosensitive member 1 will be described using the following formulas (5), (6) and (7).

$$\mathrm{Life}(l)=\mathrm{Life}(100\%)-\mathrm{Life}(t)(\mathrm{unit}:m) \tag{5}$$

$$\mathrm{Life}(l)=\Delta L(=PS\times\Delta t)(\mathrm{unit}:m) \tag{6}$$

$$N=\Delta L/(Lp+Lg)(\mathrm{unit}:\mathrm{sheet}(s)) \tag{7}$$

In the above formulas, Δt is a driving time of the photosensitive member 1 from the present (this) time until the photosensitive member 1 reaches the end of its lifetime, and ΔL is a travel distance of the photosensitive member 1 from the present time until the photosensitive member 1 reaches the end of its lifetime. Further, Lp is a length (210 mm) of the A4-sized sheet with respect to a widthwise direction (sheet feeding direction) in this embodiment, and Lg is a sheet interval distance (58 mm) in the case of continuous printing of the images on the A4-sized sheets in this embodiment. Further, PS is the peripheral speed (700 mm/sec in this embodiment) of the photosensitive member 1.

First, the formula (5) will be described. The formula (5) is a formula for calculating the remaining lifetime Life(l) from a difference between the real time amount of use life(t) and the target lifetime value Life(100%).

Next, the formula (6) will be described. The formula (6) is a formula for calculating a travelable distance ΔL of the photosensitive member 1 from the present time until the photosensitive member 1 reaches the end of its lifetime (i.e., until the lifetime ratio reaches 100%). As shown in the formula (6), the distance ΔL equals to a product of the peripheral speed PS of the photosensitive member 1 and the driving time Δt of the photosensitive member 1 from the present time until the photosensitive member 1 reaches the end of its lifetime.

Next, the formula (7) will be described. The formula (7) is a formula for calculating a printable sheet number N from the present time until the photosensitive member 1 reaches the end of its lifetime. In this embodiment, the printable sheet number N is calculated as the number of sheets in the case where A4-sized recording materials P are fed along a short side (widthwise direction) and continuous printing is carried out.

Thus, in this embodiment, on the basis of the change amount Δd of the film thickness of the protective layer 1*e* acquired from the measurement result of the change amount ΔE of the necessary exposure amount, the lifetime arrival timing of the photosensitive member 1 can be calculated as the printable sheet number N.

<6. Control Procedure>

<6-1. Potential Control and Calculation of Amount of Use and Lifetime Ratio of Photosensitive Member>

FIG. 13 is a flowchart showing a procedure of potential control and control for carrying out calculation of the amount of use and the lifetime ratio of the photosensitive member 1 in this embodiment.

The CPU 200 starts the procedure of the potential control (adjustment of the charge potential VD and the exposed portion potential VL) when execution timing (such as every print number of 5000 sheets or during actuation of the image forming apparatus 100) of the potential control arrives (S101). After the CPU 200 starts the drive of the photosensitive member 1 and turning-on of the light discharging device 40, the CPU 200 controls the charging voltage sources S1 to S4, so that the charge potentials VD are adjusted (S102). Then, the CPU 200 controls the exposure amount of the exposure device 10, so that the E-V characteristic shown in FIG. 8 is measured (S103). Then, the CPU 200 calculates, from a measurement result of the E-V characteristic, the necessary exposure amount for adjusting the exposed portion potential V1 to −100 V (S104). Further, the CPU 200 adjusts the exposure amount of the exposure device 10 so that the exposed portion potential VL is −100 V (S105).

Thereafter, the CPU 200 calculates the change amount ΔE of the necessary exposure amount from the initial state of use of the photosensitive member 1 (S106). The change amount ΔE can be acquired by a difference between the necessary exposure amount (initial value) acquired at the time of the start of use of the photosensitive member 1 and stored in the storing portion 600 and the necessary exposure amount (current (present) value) acquired time. Then, the CPU 200 calculates the change amount Δd of the film thickness of the protective layer 1*e* from the initial state of use of the photosensitive member 1 (S107). The change amount Δd can be acquired on the basis of information showing a relationship, between ΔE and Δd, which is stored in the storing portion 600 and which is shown in FIG. 11. Then, the CPU 200 calculates the real time amount of use Life(t) at this time and causes the storing portion 600 to store the calculated real time amount of use Life(t) (S108). Further, the CPU 200 calculates the lifetime ratio Life(%) at this time and causes the storing portion 600 to store the calculated lifetime ratio Life(%) (S109). The calculating methods of the real time amount of use Life(t) and the lifetime ratio Life(%) are those described above with reference to FIG. 12. Thereafter, the CPU 200 ends the procedure (S110).

<6-2. Calculation of Lifetime Arrival Timing of Photosensitive Member>

FIG. 14 is a flowchart showing a procedure of control for carrying out calculation of the lifetime arrival timing of the photosensitive member 1 in this embodiment.

The CPU 200 starts the procedure of the control of the calculation of the lifetime arrival timing of the photosensitive member 1 after the end of the procedure of FIG. 13 (S201). The CPU 200 reads the real time amount of use Life(t) and the lifetime ratio Life(%) at this time from the storing portion 600 (S202, S203). Then, the CPU 200 discriminates whether or not the lifetime ratio Life(%) at this time is not less than 10% which is a predetermined threshold (S204). In the case where the CPU 200 discriminated in S204 that the lifetime ratio Life(%) was less than 10%, the CPU 200 discriminates that the photosensitive member 1 is substantially in a brand-new state, and then ends the procedure (S209). On the other hand, in the case where the CPU 200 discriminated in S204 that the lifetime ratio Life(%) was not less than 10%, the CPU 200 calculates the lifetime arrival timing of the photosensitive member 1 (S205 to S207). In S205, the CPU 200 calculates the remaining lifetime Life(l) in accordance with the above-described formula (5). Then, in S206, the CPU 200 calculates the travelable distance ΔL in accordance with the above-described formula (6). Then, in S207, the CPU 200 calculates the printable sheet number N in accordance with the above-described formula (7). Then, the CPU 200 causes the storing portion 600 to store calculation results of the remaining lifetime Life(l), the travelable distance ΔL and the printable sheet number N which are calculated in S205 to S207 (S208). Thereafter, the CPU 200 ends the procedure (S209).

In this embodiment, at least one of the respective calculation results shown in FIGS. 13 and 14, i.e., the real time amount of use Life(t), the lifetime ratio Life(%), the remaining lifetime Life(l), the travelable distance ΔL and the printable sheet number N can be arbitrarily confirmed by the operator. It is preferable that of the respective calculation results, at least the printable sheet number N and further the lifetime ratio Life(%) can be confirmed.

Part (a) of FIG. 15 is a flowchart showing an outline of a procedure for displaying the above-described respective calculation results. The operating portion 300 is provided with an input portion such as buttons for providing an instruction to the CPU 200 so as to display at least one specific calculation result of the above-described respective calculation results or so as to selectively display at least one of the above-described respective calculation results. When the CPU 200 receives the display instruction from the operating portion 300 (S301), the CPU 200 reads the corresponding calculation result stored in the storing portion 600 (S302). Then, the CPU 200 causes the operating portion 300 to display the read corresponding calculation result (S303). The respective above-described calculation results displayed at this time may also be the calculation result during the latest potential control. Or, the above-described respective calculation results displayed at this time may also be renewed to a value calculated in consideration of a changed of the film thickness of the photosensitive member 1 from the time of the latest potential control to the present time in order to provide a value more in conformity with the present time. For example, the real time amount of use Life(t) can be changed to a value obtained by adding, to the calculation result during the latest potential control, an amount of use calculated in accordance with the above-described formula (2) by the operation from after the latest potential control until the present time. Further, correspondingly thereto, the lifetime ratio Life(%), the remaining lifetime Life(l), the travelable distance ΔL and the printable sheet number N can be changed to values calculated in accordance with the above-described formulas (3) to (7). Or, the printable sheet number N may also be changed to a value obtained by subtracting, from the calculation result during the latest potential control, a print number by the operation from after the latest potential control until the present time.

Further, on the basis of the respective calculation results in the pieces of control shown in FIGS. 13 and 14, in the case where the amount of use of the photosensitive member 1 reaches the predetermined value, the CPU (output portion) 200 outputs data to the display portion and can cause the display portion to display predetermined warning display. This warning display may also be a display (character, turning-on of a lamp, voice or the like) for notifying that the photosensitive member 1 reaches exchange timing or that the photosensitive member 1 approaches the exchange timing. Part (b) of FIG. 15 is a flowchart showing an outline of a procedure for carrying out the warning display. After the ends of the procedures of FIGS. 13 and 14, the CPU 200 reads the lifetime ratio Life(%) stored in the storing portion 600 (S401). Then, the CPU 200 discriminates whether or not the read lifetime ratio Life(%) reaches a predetermined value (threshold "THD") (for example, 100%) (S402). Then, in the case where the CPU 200 discriminated that the lifetime ratio Life(%) reached the predetermined value, the CPU 200 causes the operating portion (display portion) 300 to display the warning display (S403). Incidentally, in place of the lifetime ratio Life(%), in the case where the remaining lifetime Life(l) (or the travelable distance ΔL) reached a predetermined value (for example, 0 m) or in the case where the printable sheet number N reached a predetermined value (for example, 0 sheets), the warning display may also be carried out. Further, the warning display may also be carried out on the basis of a renewed value of the calculation result during the latest potential control similarly as described above. Each of the predetermined thresholds compared with the above-described lifetime ratio Life(%) and the like may also be set at a plurality of levels (values), and in this case, the warning display can be stepwisely carried out as the photosensitive member 1 approaches the end of its lifetime. Incidentally, the change amount Δd of the film thickness of the protective layer 1*e* acquired similarly as in this embodiment and the threshold of the change amount Δd set as the lifetime of the photosensitive member 1 are compared with each other, and in the case where the photosensitive member 1 simply reaches the end of its lifetime or in the case where the photosensitive member 1 approaches the end of its lifetime, such a state may also be notified to the operator by the warning display.

As described above, according to this embodiment, information on the change amount of the film thickness of the protective layer 1*e* is acquired on the basis of the measurement result of the E-V characteristic (photosensitive characteristic) of the photosensitive member 1. As a result, progression of the change of the film thickness of the protective layer 1*e* until the photosensitive member 1 reaches the end of its lifetime is monitored and the (end of the) lifetime of the photosensitive member 1 is predicted, so that maintenance control of the photosensitive member 1 can be carried out. That is, in this embodiment, the information on the change amount of the film thickness of the protective layer 1*e* can be acquired with accuracy by a simple constitution without providing an exclusive measuring device. Further, the amount of use of the photosensitive member 1 is monitored with accuracy without providing the exclusive measuring device, and the lifetime of the photosensitive member 1 is predicted with accuracy, so that the maintenance control of the photosensitive member 1 can be carried out. Accordingly, in the case where the change amount of the film thickness of the protective layer 1*e* reached the predetermined value or before the change amount reaches the predetermined value, the photosensitive member 1 can be exchanged at proper timing, so that generation of the image defect can be suppressed.

Embodiment 2

Another embodiment of the present invention will be described. A basic structure and a basic operation of an image forming apparatus in this embodiment are the same as those in Embodiment 1. Accordingly, in the image forming apparatus in this embodiment, elements having the same or corresponding functions or structures as those of the image forming apparatus in Embodiment 1 are represented by the same reference numerals or symbols as in Embodiment 1 and will be omitted from detailed description.

In Embodiment 1, the prediction of the lifetime of the photosensitive member 1 was carried out using the ideal line shown in FIG. 12. However, in some cases, the abrasion amount of the photosensitive member 1 fluctuates by the influence of a status of use (operation (use) environment, the image forming condition, a change of frictional force of the cleaning member, or the like) of the image forming apparatus 100. Therefore, in this embodiment, depending on a fluctuation of the abrasion amount of the protective layer 1*e* depending on the status of use of the image forming apparatus 100, the predicted value of the lifetime of the photosensitive member 1 is corrected.

In this embodiment, by the same method as that of Embodiment 1, it is possible to acquire the real time amount of use Life(t), the lifetime ratio Life(%), the remaining lifetime Life(l), the travelable distance ΔL and the printable sheet number N. That is, these values are acquired on the basis of the change amount Δd of the film thickness of the protective layer 1*e* acquired from the measurement result of the change amount ΔE of the necessary exposure amount.

In addition, in this embodiment, during each of pieces of the potential control, in accordance with the formula (2) described in Embodiment 1, "Life(T)" which is a real time amount of use calculated using the charging time tc and the drive time t which are measured by the timer 400 is acquired. Further, "Life(%)'" which is a lifetime ratio calculated in accordance with the formula (4) described in Embodiment 1 is acquired using Life(t)'.

FIG. 16 is a graph for illustrating a correcting method of the predicted value of the lifetime of the photosensitive member 1 in this embodiment. In FIG. 16, the abscissa represents Δd, and the ordinate represents the amount of use of the photosensitive member 1. In FIG. 16, "●" is a plot of the real time amount of use Life(t)' calculated in accordance with the above-described formula (2) at execution timing of the associated potential control relative to Δd acquired at the execution timing. In FIG. 16, α is a plot at the time of present (latest) potential control, and β is a plot at the time before the preceding (past) potential control (at the time of last potential control in which the change amount of Life(%)' is not less than 10% in this embodiment as described later).

In this embodiment, a slope γ (=ΔLife(α−β)/Δd(α−β)) which is a proportion of a difference ΔLife(α−β) of the real time amount of use Life(t)' to a difference Δ(α−β) of the change amount Δd of the film thickness of the protective layer 1*e* between the plot α and the plot β is acquired. Then, by using this slope γ, correction of the printable sheet number N acquired by the same method as that of Embodiment 1 is carried out, so that a printable sheet number N' after the correction is acquired. This corresponds to acquirement of the printable sheet number N' on a correction line with the slope γ (=ΔLife(α−β)/Δd(α−β)) by correcting the ideal line described in Embodiment 1 to the correction line with the slope γ. That is, the printable sheet number N' after the correction is calculated by the following formula (8).

$$N'=N/\gamma \tag{8}$$

In the case where the slope γ is larger than a slope of the ideal line, an abrasion speed of the protective layer 1*e* is faster (higher) than an abrasion speed of the protective layer 1*e* in the status (state) of use shown by the ideal line, and therefore, the printable sheet number N' after the correction is corrected so as to be smaller than the printable sheet number before the amendment. On the other hand, in the case where the slope γ is smaller than the slope of the ideal line, the abrasion speed of the protective layer 1*e* is slower (lower) than that in the status of use shown by the ideal line, and therefore, the printable sheet number N' after the correction is corrected so as to be larger than the printable sheet number N before the correction.

In this embodiment, the slope γ is calculated between the plot α and the plot β in which the lifetime ratios Life(%)' therebetween are different from each other by 10% or more. Particularly, in this embodiment, the plot β is a plot at the time of latest potential control in which Life(%)' thereof is different from Life(%)' of the plot α by 10% or more. This is because the target lifetime of the photosensitive member 1 is a relatively long lifetime which is a print number of 6000K ($6000\times10^3$) sheets, and therefore, the correction of the predicted value of the lifetime of the photosensitive member 1 can be carried out with accuracy by using a slope γ between plots providing the lifetimes which are different from each other by the print number of about 600K sheets which is 10% of the print number of 6000K sheets. However, an interval between the plots where the slopes γ are acquired is not limited thereto, but may appropriately be changed depending on the film thickness of the protective layer 1*e* of the photosensitive member 1, the lifetime condition of the photosensitive member 1, a change of surface roughness of the photosensitive member 1 due to the operation environment or the like, or the like factor. Further, an approximate rectilinear line (approximate expression) is acquired using a plurality of plots (for example, all of plots from an initial value to a present value, all or a part of plots before the previous value, or the like), and slope of the approximate rectilinear line may also be used as the above-described slope γ.

FIG. 17 is a flowchart showing a procedure of control for carrying out the correction of the predicted value of the lifetime of the photosensitive member 1 in this embodiment. After the ends of the procedures of FIGS. 13 and 14 described in Embodiment 1, the CPU 200 starts the procedure of the correction of the predicted value of the lifetime of the photosensitive member 1 (S501). The procedures of FIGS. 13 and 14 are similar to those described in Embodiment 1, but in this embodiment, at execution timing of each of pieces of the potential control, also the values Life(t)' and Life(%)' are calculated in S108 and S109 of the procedure of FIG. 13 and are stored in the storing portion 600. The CPU 200 reads present values of Δd, Life(t), Life(%), Life(t)' and Life(%)' from the storing portion 600 (S502, S503). Then, the CPU 200 discriminates whether or not the present value Life(%) is not less than 10% which is the predetermined threshold (S504). In the case where the CPU 200 discriminated in S504 that Life(%) is less than 10%, the CPU 200 discriminates that the photosensitive member 1 is substantially in a brand-new state, and ends the procedure (S510). On the other hand, in the case where the CPU 200 discriminated in S504 that Life(%) is not less than 10%, the CPU 200 carries out calculation of correction of the predicted value of the lifetime of the photosensitive member 1 (S505 to S508). In S505, the CPU 200 reads, from the storing portion 600, Δd and Life(t)' at the time of the latest potential control in which Life(%)' at the time of the past potential control is smaller than Life(%)' at the time of the present potential control by 10% or more. Then, in S506, the CPU 200 calculates the slope γ (=ΔLife(α−β)/Δd(α−β)) by using the information read in S502 and S505. Then, in S507, the CPU 200 reads the present printable sheet number N before the correction. Then, in S508, the CPU 200 calculates the printable sheet number N' (=N/γ) after the correction from the present printable sheet number N before the correction and the slope γ. Then, the CPU 200 causes the storing portion 600 to store a calculation result of the printable sheet number N' after the correction in S508 (S509). Thereafter, the CPU 200 ends the procedure (S510).

In this embodiment, in the control shown in part (a) of FIG. 15, the printable sheet number N' after the correction during the latest potential control may only be required to be displayed at the operating portion 300 at arbitrary timing in response to the instruction from the operator. At the arbitrary timing, a value obtained by subtracting, from the printable sheet number N' after the correction during the latest potential control, the print number by a subsequent operation may also be displayed. Further, in this embodiment, in the control shown in part (b) of FIG. 15, the warning display may only be required to be carried out in the case where the printable sheet number N' after the correction during the latest potential control or a value obtained by renewing the printable sheet number N' depending on a subsequent operation reaches a predetermined value (for example, 0 sheet).

As described above, according to this embodiment, even when the abrasion state of the protective layer 1*e* due to the use of the photosensitive member 1 fluctuates relative to an ideal state depending on the status (state) of use of the image forming apparatus 100, the lifetime of the photosensitive member 1 can be predicted with accuracy. As a result, in this embodiment, prediction accuracy of the lifetime of the photosensitive member 1 is improved compared with Embodiment 1.

Embodiment 3

Another embodiment of the present invention will be described. A basic structure and a basic operation of an image forming apparatus in this embodiment are the same as those in Embodiment 1. Accordingly, in the image forming apparatus in this embodiment elements having the same or corresponding functions or structures as those of the image forming apparatus in Embodiment 1 are represented by the same reference numerals or symbols as in Embodiment 1 and will be omitted from detailed description.

In this embodiment, the image forming apparatus 100 has a function of sending, to an outside of the image forming apparatus 100, information such as a predicted value of the lifetime of the photosensitive member 1 described in Embodiments 1 and 2.

FIG. 18 is a block diagram showing a schematic control mode of a principal part of the image forming apparatus 100 in this embodiment. In this embodiment, the image forming apparatus 100 includes a communicating portion 900 for carrying out communication with an external device of the image forming apparatus 100. The communicating portion 900 constitutes a communicating means for sending the information to the external device communicatably connected with the image forming apparatus 100. The CPU 200 causes the communicating portion 900 to send maintenance information, stored in the storing portion 600, to the external device of the image forming apparatus 100 at predetermined timing. As a result, in the external device, the maintenance information can be displayed for the operator of the image forming apparatus 100 or a maintenance person. In this embodiment, the maintenance information includes at least ΔDay and lifetime arrival date which are described later. The maintenance information may further include at least one of the result of the potential control, ΔE, Δd, Life(t), Life(%), Life(l), ΔL, N, Life(t)' Life(%)' and N. Further, in this embodiment, the CPU 200 sends the maintenance information to the external device every execution of the potential control as predetermined timing.

In this embodiment, in order to permit exchange of the photosensitive member 1 at proper timing, the data when the photosensitive member 1 reaches the end of the lifetime thereof is calculated using the following formulas (9) and (10), and is sent as the maintenance information to the external device.

$$\Delta\text{Day}=N/M \tag{9}$$

$$\text{DATE(lifetime arrival date)}=\text{DATE(today)}+\Delta\text{Day} \tag{10}$$

Here, M is an average print number per day. Further, N is a printable sheet number until the photosensitive member 1 reaches the end of its lifetime. ΔDay is a predicted value of the number of days until the photosensitive member 1 reaches the end of its lifetime. In this embodiment, the correction of the predicted value of the lifetime of the photosensitive member 1 is carried out similarly as in Embodiment 2, and the printable sheet number N is the printable sheet number after the correction as described in Embodiment 2 (i.e., the above-described formula (9) is ΔDay=N'/M in this embodiment).

First, the formula (9) will be described. The formula (9) is a formula for calculating the number of days, until the photosensitive member 1 reaches the end of its lifetime, by dividing the printable sheet number N by the average print number (A4-sized sheet basis) per day in the image forming apparatus 100. In this embodiment, the average print number M per day in the image forming apparatus 100 is stored in the storing portion 600. Particularly, in this embodiment, the average print number M inputted from the operating portion 300 by the operator (the user or the maintenance person) is stored in the storing portion 600.

Then, the formula (10) will be described. The formula (10) is a formula for calculating the date, when the photosensitive member 1 reaches the end of its lifetime, by adding ΔDay calculated by the formula (9) to the date of today (the time of the latest potential control).

Thus, in this embodiment, prediction calculation of the lifetime arrival date of the photosensitive member 1 is carried out. In this embodiment, the average print number M is stored in advance in the storing portion 600 of the image forming apparatus 100 by the operator, but the present invention is not limited thereto. The image forming apparatus 100 includes a means for monitoring operation information and may cause the storing portion 600 to appropriately store the operation information so that the average print number per day is adapted to the latest operation state. As a result, prediction accuracy of the lifetime arrival date of the photosensitive member 1 can be improved.

FIG. 19 is a flowchart showing a procedure of control for sending the maintenance information in this embodiment.

The CPU 200 starts the sending procedure of the maintenance information after the end of the procedure of FIG. 17 described in Embodiment 2 (S601). The CPU 200 reads a result of the present potential control and a present lifetime ratio Life(%) (S602). Next, the CPU 200 discriminates whether the lifetime ratio Life(%) is not less than 10% which is the predetermined threshold (S603). In the case where the CPU 200 discriminated in S603 that the lifetime ratio Life(%) was less than 10%, the CPU 200 discriminates that the photosensitive member 1 is substantially in a brand-new state and causes the procedure to go to S606. In this case, the CPU 200 causes the storing portion 600 to store, as sending data the result of the present potential control and the present lifetime ratio Life(%) (S606), and sends the sending data to the external device (S607), and then ends the procedure (S608). On the other hand, in the case where the CPU 200 discriminated in S603 that the lifetime ratio Life(%) is not less than 10%, the CPU 200 reads the result of the present potential control and calculation results of pieces of the control of FIGS. 13, 14 and 17 (S604). At this time, in this embodiment, the CPU 200 reads all of data relating to the prediction of the lifetime of the predict 1, i.e., Δd, Life(t), Life(%), Life(t)', Life(%)', N, N' and the average print number M. Then, the CPU 200 calculates, from the printable sheet number N' after the correction and the average print number M, ΔDay which is the number of days until the photosensitive member 1 reaches the end of its lifetime and the lifetime arrival date in accordance with the above-described formulas (9) and (10) (S605). Next, the CPU 200 causes the storing portion 600 to store, as sending data, the result of the present potential control, the all of data relating to the prediction of the lifetime of the photosensitive member 1, and the calculated ΔDay and the calculated lifetime arrival date (S606). Then, the CPU 200 sends the sending data to the external device (S607), and thereafter ends the procedure (S608).

In this embodiment, the lifetime arrival date acquired on the basis of the printable sheet number N' after the correction is sent to the external device, but a difference between the lifetime arrival dates acquired on the basis of the printable sheet number N before the correction and the printable sheet number N' after the correction is acquired, and then information on this difference may also be sent to the external device. As a result, in the case where a maintenance plan is prepared on the basis of the ideal line described in Embodiment 1 or in the like case, even when it is predicted that the photosensitive member 1 reaches the end of its lifetime at timing deviated from timing of the plan, the maintenance person can easily perform the maintenance. Further, depending on a demand from the external device, the CPU 200 may also send the maintenance information to the external device.

As described above, in this embodiment, progression of the film thickness from the start of use of the photosensitive member 1 to the arrival at the end of the lifetime of the photosensitive member 1 (i.e., the progression of the remaining lifetime of the photosensitive member 1) can be monitored by the external device. As a result, the user and the maintenance operator of the image forming apparatus 100 can easily monitor the state of the photosensitive member 1 and thus can easily grasp the exchange timing of the photosensitive member 1. For that reason, when or before the photosensitive member 1 reaches the end of its lifetime, the photosensitive member 1 can be exchanged at proper timing, so that it is possible to suppress generation of an image defect.

Other Embodiments

In the above, the present invention was described based on specific embodiments, but is not limited to the above-described embodiments.

In the above-described embodiments, as the information on the change amount due to the use of the photosensitive member 1, of the necessary exposure amount for changing the predetermined charge potential VD to the predetermined exposed portion potential VL, the change amount ΔE of the necessary exposure amount itself acquired from the E-V characteristic shown in FIG. 8 was obtained. However, the present invention is not limited to such a constitution. For example, as the information on the change amount, due to the use of the photosensitive member 1, of the necessary exposure amount for changing the predetermined charge potential VD to the predetermined exposed portion potential VL, the change amount of the slope α (=ABS(ΔVL/ΔE)) of the V-E characteristic shown in FIG. 8 may also be acquired. In this case, the change amount Δd of the film thickness of the protective layer 1*e* can be acquired from the change amount of the slope α of the E-V characteristic acquired in advance and the change amount Δd of the film thickness of the protective layer 1*e*. Further, as the information on the change amount, due to the use of the photosensitive member 1, of the necessary exposure amount for changing the predetermined charge potential VD to the predetermined exposed portion potential VL, a change amount of a latent image contrast potential difference may also be acquired. In this case, the change amount Δd of the film thickness of the protective layer 1*e* can be acquired from a relationship between the change amount of the latent image contrast potential difference acquired in advance and the change amount Δd of the film thickness of the protective layer 1*e*. That is, the information may only be required so that the change amount of the exposure amount of the exposure device 10, due to the change of the film thickness of the protective layer 1*e*, necessary to form the exposed portion potential VL with respect to the predetermined charge potential VD. The change amount of the above-described slope α and the change amount of the latent image contrast are pieces of information from which the change amount of the necessary exposure amount due to the change of the film thickness of the protective layer 1*e* can be known since each of the change amount of the slope α and the change amount of the latent image contrast is proportional to the change amount ΔE of the necessary exposure amount in the above-described embodiments.

Further, in the above-described embodiments, the information on the lifetime of the photosensitive member 1 was acquired on the basis of the threshold (upper limit value) of the change amount Δd of the film thickness of the protective layer 1*e* set in advance as the lifetime of the photosensitive member 1. However, the film thickness of the protective layer 1*e* in the initial state of use of the photosensitive member 1 changes in some cases due to a difference among individuals and a difference in production lot of the photosensitive member 1. Therefore, the image forming apparatus 100 can be provided with a storing portion for storing information on a separately measured film thickness (initial film thickness) of the protective layer 1*e* in the initial state of use of the photosensitive member 1. Then, on the basis of this initial film thickness, the threshold of Δd set as the lifetime is corrected, and correspondingly thereto, the target lifetime Life(100%) in conformity with the ideal line can be corrected. As a result, the prediction of the lifetime of the photosensitive member 1 can be corrected. The information on the initial film thickness may also be the film thickness itself or the threshold of Δd depending on the initial film thickness. As the storing portion, it is possible to use the storing portion 600 (FIGS. 4 and 18) provided in the apparatus main assembly 110 and a storing portion (not shown) detachably mountable, together with the photosensitive member 1, to the apparatus main assembly 110. In the case of using the storing portion 600, the operator may only be required to input the information through the operating portion 300 or to input the information read from the storing portion detachably mountable, together with the photosensitive member 1, to the apparatus main assembly 110. Further, in the case of using the storing portion detachably mountable, together with the photosensitive member 1, to the apparatus main assembly 110, the storing portion may also be mounted to a cartridge including the photosensitive member 1. The cartridge may be a cartridge including the photosensitive member 1 which is substantially detachably mountable to the apparatus main assembly 110 alone or may also be a process cartridge. The process cartridge is prepared by integrally assembling, in general, the photosensitive member and at least one of the charging means, the developing means and the cleaning means which are used as process means actable on the photosensitive member, into a unit detachably mountable to the apparatus main assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-225551 filed on Nov. 18, 2016, which is hereby incorporated by reference herein in its entirety.

What is claimed is:

1. An image forming apparatus comprising:

a photosensitive member including a photosensitive layer made of amorphous silicon and a protective layer made of inorganic material provided outside said photosensitive layer;

a charger configured to electrically charge said photosensitive member;

an exposure light source configured to expose, to light, said photosensitive member charged by said charger;

a detector configured to detect a surface potential of said photosensitive member;

a controller configured to operate in an acquiring mode at predetermined timing during non-image formation, wherein in the acquiring mode said controller controls a charging condition of said charger so that a surface potential of said photosensitive member after being charged reaches a first surface potential, controls an exposure amount of said exposure light source which exposes said charged photosensitive member so the surface potential thereof reaches a second surface potential, and acquires the controlled exposure amount; and an output circuit configured to output information on a lifetime of said photosensitive member, wherein said output circuit outputs the information in a case where a ratio Life(%) satisfies $0<\text{Life}(\%)<1$ and is less than or equal to a predetermined value, and wherein the ratio Life(%) is a ratio of the exposing amount acquired at a timing after an initial state of use of said photosensitive member to the exposing amount acquired in the initial state of use.

2. An image forming apparatus according to claim 1, further comprising a memory configured to store information on a thickness of said protective layer in an initial state of use of said photosensitive member, wherein said output circuit outputs the information on the lifetime of said photosensitive member on the basis of the information stored in said memory.

3. An image forming apparatus according to claim 1, further comprising a notifying circuit configured to notify of information, wherein said output circuit causes said notifying circuit to display the information on the lifetime of said photosensitive member.

4. An image forming apparatus according to claim 1, further comprising a sending circuit configured to send information to an external device communicatably connected with said image forming apparatus, wherein said output circuit causes said sending circuit to send the information on the lifetime of said photosensitive member to the external device.

* * * * *